US008191993B2

(12) United States Patent
Inoue

(10) Patent No.: US 8,191,993 B2
(45) Date of Patent: Jun. 5, 2012

(54) NOZZLE PLATE FOR LIQUID EJECTOR HEAD, LIQUID EJECTOR HEAD, LIQUID EJECTOR, LIQUID EJECTION METHOD, INKJET RECORDING APPARATUS, AND INKJET RECORDING METHOD

(75) Inventor: Tomohiro Inoue, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 591 days.

(21) Appl. No.: 12/438,812

(22) PCT Filed: May 14, 2008

(86) PCT No.: PCT/JP2008/059292

§ 371 (c)(1),
(2), (4) Date: Feb. 25, 2009

(87) PCT Pub. No.: WO2008/155970

PCT Pub. Date: Dec. 24, 2008

(65) Prior Publication Data

US 2010/0097423 A1 Apr. 22, 2010

(30) Foreign Application Priority Data

Jun. 21, 2007 (JP) ..... 2007-163634

(51) Int. Cl.
*B41J 2/14* (2006.01)
*B41J 2/16* (2006.01)

(52) U.S. Cl. ..... 347/47; 347/45

(58) Field of Classification Search ..... 347/29, 347/40, 45–47, 49, 64, 67, 71; 106/31.13
See application file for complete search history.

(56) References Cited

U.S. PATENT DOCUMENTS

| | | | | |
|---|---|---|---|---|
| 5,378,504 | A | 1/1995 | Bayard et al. | |
| 7,232,206 | B2 * | 6/2007 | Sasaki et al. | 347/45 |
| 7,370,576 | B2 * | 5/2008 | Nakamura et al. | 101/119 |
| 7,926,910 | B2 * | 4/2011 | Cha et al. | 347/45 |

FOREIGN PATENT DOCUMENTS

| | | | |
|---|---|---|---|
| EP | 0712726 | A2 | 5/1996 |
| EP | 1010802 | A2 | 6/2000 |
| JP | 63 122560 | | 5/1988 |
| JP | 05 345419 | | 12/1993 |
| JP | 06 040040 | | 2/1994 |
| JP | 07 329303 | | 12/1995 |

(Continued)

OTHER PUBLICATIONS

Supplementary European Search Report issued Feb. 27, 2012 in EPO8 75 3020.

(Continued)

*Primary Examiner* — Thinh Nguyen
(74) *Attorney, Agent, or Firm* — Oblon, Spivak, McClelland, Maier & Neustadt, L.L.P.

(57) ABSTRACT

The present invention provides a nozzle plate for liquid ejector head and a liquid ejector head. The nozzle plate for liquid ejector head includes at least a nozzle hole for ejecting droplets composed of an ejection liquid, wherein the surface energy of an inner wall of the nozzle hole at 25° C. is lower than the surface tension of the ejection liquid at 25° C. and is substantially same as the surface energy of the ejection side surface of the nozzle plate at 25° C.

15 Claims, 6 Drawing Sheets

FOREIGN PATENT DOCUMENTS

| | | |
|---|---|---|
| JP | 08 224878 | 9/1996 |
| JP | 09 216370 | 8/1997 |
| JP | 10 086351 | 4/1998 |
| JP | 10 217483 | 8/1998 |
| JP | 10-217497 | 8/1998 |
| JP | 2001 187447 | 7/2001 |
| JP | 2001 187453 | 7/2001 |
| JP | 2002 292877 | 10/2002 |
| JP | 2003 019803 | 1/2003 |
| JP | 2004 001494 | 1/2004 |
| JP | 2004 017439 | 1/2004 |
| JP | 2004 025657 | 1/2004 |
| JP | A 2004-330681 | 11/2004 |
| JP | A 2006-281767 | 10/2006 |
| WO | 99 15337 | 4/1999 |

OTHER PUBLICATIONS

Office Action issued Apr. 10, 2012 in Japanese Application No. 2008-125950, filed May 13, 2008. (without an English Translation).

* cited by examiner

NOZZLE PLATE FOR LIQUID EJECTOR HEAD, LIQUID EJECTOR HEAD, LIQUID EJECTOR, LIQUID EJECTION METHOD, INKJET RECORDING APPARATUS, AND INKJET RECORDING METHOD

TECHNICAL FIELD

The present invention relates to a nozzle plate for liquid ejector head and a liquid ejector head, a liquid ejector and a liquid ejection method each of which uses the nozzle plate and the liquid ejector head, an inkjet recording apparatus and an inkjet recording method.

BACKGROUND ART

There have been various liquid ejectors proposed each of which ejects droplets from a head by pressurizing a liquid flow channel for use in printers, facsimiles, copiers, or complex machines thereof, various types of image forming apparatuses such as plotters or other various types of patterning devices.

In such a liquid ejector, water-repellency is generally imparted to the ejection side surface of a nozzle, because when the periphery of the nozzle surface gets wet with ejected liquid, the droplet flying direction may deviate from the normal direction, causing defective wiping of the nozzle surface.

Further, a flow channel surface for an ejection liquid in a nozzle hole, i.e., an inner wall of a nozzle hole is preferably hydrophilic from the perspective of the filling property of an ejection liquid and the meniscus stability (see Patent Literature 1, Patent Literature 2, Patent Literature 3, and Patent Literature 4). Such a hydrophilic inner wall of a nozzle hole has less up-and-down move of the meniscus and can keep the meniscus positioning constant, but the meniscus holding force is weak and the meniscus itself becomes easily broken due to a variation in pressure applied inside and outside the nozzle. Therefore, water repellency is imparted to only the region near the ejection port in the nozzle hole, similarly to the nozzle surface (see Patent Literature 5, Patent Literature 6, Patent Literature 7, Patent Literature 8, and Patent Literature 9). However, the above-mentioned proposals cause a boundary between a hydrophilic region and a water-repellent region in a nozzle hole, and thus there is a need to precisely control the position of a water-repellent layer inside a nozzle hole for all the nozzles to be used. As mentioned above, various methods have been disclosed in the prior art, however, they are not necessarily satisfactory.

Furthermore, there have been proposals for imparting water repellency to the entire inner surface of a nozzle hole (see Patent Literature 10, Patent Literature 11, Patent Literature 12, and Patent Literature 13). However, these proposals are insufficient in terms of the filling property of ejection liquid and the meniscus stability.

As described above, it is still extremely difficult to satisfy all of the filling property, ejection stability and reliability by controlling the wettability to an ejection liquid inside a nozzle hole.

In the meanwhile, liquid ejectors have become increasingly utilized for printers, facsimiles, copiers, or complex machines thereof, various types of image forming apparatuses such as plotters or other various types of patterning devices, and have become required to be used for an ejection liquid having various physical properties such as surface tension and viscosity. For example, recent inkjet printers are required to have still higher quality of images and higher durability, and actually, there have been provided various improvements in physical properties of inks as ejection liquids, for example, (1) the surface tension of an ink is reduced to increase the permeability to paper as a recording medium, thereby improving color-developing property of the ink; (2) the photo resistance and water resistance property are improved by using a pigment as a colorant for ink; and (3) the image fixing property is improved by adding a resin to an ink. Currently, it is strongly desired to provide a nozzle plate for inkjet head with which such an ink can be stably used.

[Patent Literature 1] Japanese Patent Application Laid-Open (JP-A) No. 6-40040

[Patent Literature 2] Japanese Patent Application Laid-Open (JP-A) No. 7-329303

[Patent Literature 3] Japanese Patent Application Laid-Open (JP-A) No. 2004-25657

[Patent Literature 4] Japanese Patent Application Laid-Open (JP-A) No. 2004-1494

[Patent Literature 5] Japanese Patent Application Laid-Open (JP-A) No. 63-122560

[Patent Literature 6] Japanese Patent Application Laid-Open (JP-A) No. 10-217483

[Patent Literature 7] Japanese Patent Application Laid-Open (JP-A) No. 2001-187453

[Patent Literature 8] Japanese Patent Application Laid-Open (JP-A) No. 2003-19803

[Patent Literature 9] International Publication No. WO99/15337

[Patent Literature 10] Japanese Utility Model Application Laid-Open (JP-U) No. 57-153540

[Patent Literature 11] Japanese Patent Application Laid-Open (JP-A) No. 5-345419

[Patent Literature 12] Japanese Patent Application Laid-Open (JP-A) No. 9-216370

[Patent Literature 13] Japanese Patent Application Laid-Open (JP-A) No. 2001-187447

DISCLOSURE OF INVENTION

The present invention aims to provide a nozzle plate for liquid ejector head and a liquid ejector head each of which is provided with filling property, ejection stability and reliability, and a liquid ejector, a liquid ejection method each of which uses the nozzle plate and the liquid ejector head, as well as an inkjet recording apparatus and an inkjet recording method.

As a result of studies and investigations to solve the above-mentioned problems, the inventors have studied and investigated countermeasures to them, and have obtained the following findings. The above objects can be achieved by defining the surface properties of an inner wall of a nozzle hole in accordance with a liquid to be ejected therefrom. Specifically, the inventors found that a nozzle plate for liquid ejector head provided with ejection stability, filling property and reliability can be obtained by setting the surface energy of the inner wall of a nozzle hole at 25° C. lower than that of a liquid to be ejected from the nozzle hole (an ejection liquid) at 25° C.

In this case, following embodiments are effective: an embodiment where the surface energy of an inner wall of a nozzle hole is same as that of the nozzle plate surface; an embodiment where a difference between the surface energy of an inner wall of a nozzle hole and the surface tension of an ejection liquid is 10 mN/m or lower; an embodiment where the surface energy of an inner wall of a nozzle hole is 25 mN/m or lower; and an embodiment where an inner wall of a nozzle hole contains a silicone resin or a fluorine-based water-repellency imparting agent.

Means to solve the above-mentioned problems are as follows.

<1> A nozzle plate for liquid ejector head having at least a nozzle hole for ejecting droplets composed of an ejection liquid, wherein the surface energy of an inner wall of the nozzle hole at 25° C. is lower than the surface tension of the ejection liquid at 25° C. and is substantially same as the surface energy of the ejection side surface of the nozzle plate at 25° C.

<2> The nozzle plate for liquid ejector head according to the item <1>, wherein a difference (B−A) of a surface tension (B) of the ejection liquid at 25° C. minus a surface energy (A) of the inner wall of the nozzle hole at 25° C. is higher than 0 mN/m and equal to or lower than 10 mN/m.

<3> The nozzle plate for liquid ejector head according to any one of the items <1> to <2>, wherein the surface energy of the inner wall of the nozzle hole at 25° C. is 25 mN/m or lower.

<4> The nozzle plate for liquid ejector head according to any one of the items <1> to <3>, wherein the inner wall of the nozzle hole contains a silicone resin.

<5> The nozzle plate for liquid ejector head according to any one of the items <1> to <3>, wherein the inner wall of the nozzle hole contains a fluorine-based water-repellency imparting agent.

<6> A liquid ejector head having the nozzle plate for liquid ejector head according to any one of the items <1> to <5>.

<7> A liquid ejector having at least the liquid ejector head according to the item <6>.

<8> A liquid ejection method including: using at least the liquid ejector head according to the item <6>.

<9> An inkjet recording apparatus having at least the liquid ejector according to the item <7>, wherein an ink used as an ejection liquid is ejected by using the liquid ejector to thereby record an image.

<10> The inkjet recording apparatus according to the item <9>, wherein the viscosity of the ink is 5.0 mPa·s or more at 25° C.

<11> The inkjet recording apparatus according to any one of the items <9> to <10>, wherein the ink contains a pigment as a colorant.

<12> The inkjet recording apparatus according to any one of the items <9> to <11>, wherein the ink contains a resin.

<13> The inkjet recording apparatus according to any one of the items <9> to <12>, wherein the ink contains a fluorochemical surfactant.

<14> An inkjet recording method which includes using at least the liquid ejection method according to the item <8>, wherein an ink used as an ejection liquid is ejected according to the liquid ejection method to thereby record an image.

<15> The inkjet recording method according to the item <14>, wherein the viscosity of the ink is 5.0 mPa·s or more at 25° C.

<16> The inkjet recording method according to any one of the items <14> to <15>, wherein the ink contains a pigment as a colorant.

<17> The inkjet recording method according to any one of the items <14> to <16>, wherein the ink contains a resin.

<18> The inkjet recording method according to any one of the items <14> to <17>, wherein the ink contains a fluorochemical surfactant.

A nozzle plate for liquid ejector head according to the present invention has a nozzle hole for ejecting droplets composed of an ejection liquid and the surface energy of the inner wall of the nozzle hole at 25° C. is lower than the surface tension of the ejection liquid at 25° C., the surface energy of the inner wall of the nozzle hole at 25° C. is substantially same as the surface energy of the ejection side surface of the nozzle plate at 25° C. and thus by optimizing the surface properties of the inner wall of the nozzle hole in accordance with a liquid to be ejected from the nozzle (an ejection liquid), it is possible to provide the nozzle plate for liquid ejector head with ejection stability, filling property and reliability.

A liquid ejector head according to the present invention has a nozzle plate for liquid ejector head of the present invention, and thus the liquid ejector head is provided with ejection stability, filling property and reliability and can be preferably used in printers, facsimiles, copiers or complex machines thereof, various types of image forming apparatuses such as plotters or other various types of patterning devices.

Figure 1:
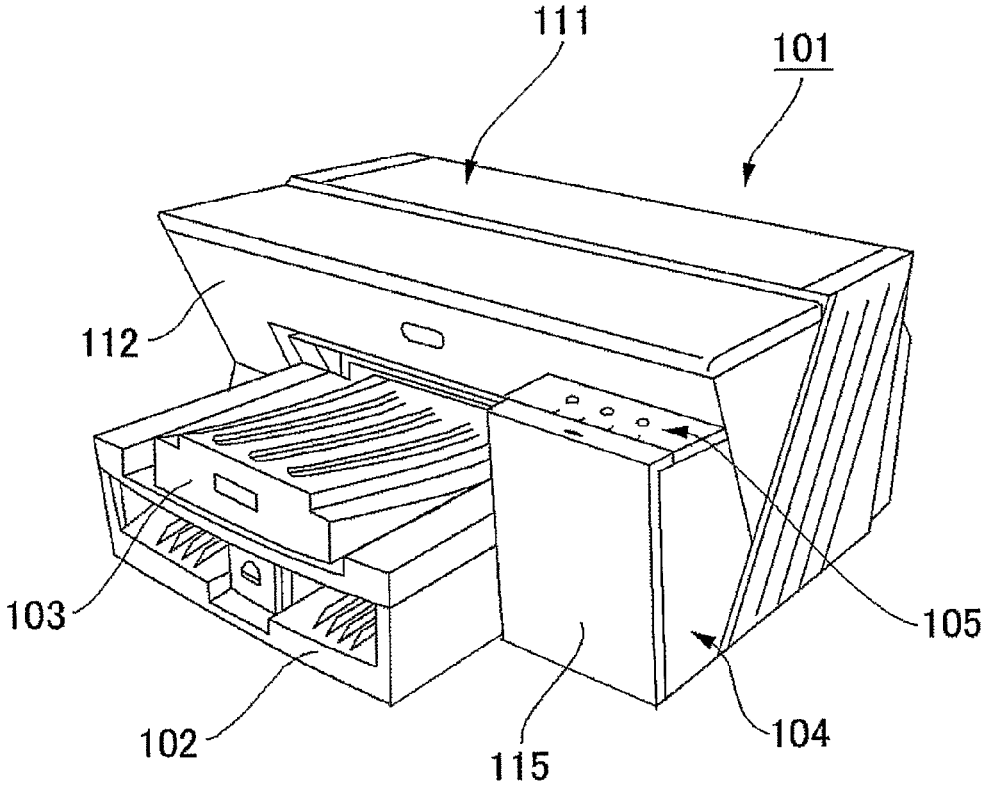
FIG. 1 is a perspective view showing one embodiment of an inkjet recording apparatus according to the present invention.

BEST MODE FOR CARRYING OUT THE INVENTION (Nozzle Plate for Liquid Ejector Apparatus, Liquid Ejector Head, Liquid Ejector, and Liquid Ejection Method)

A nozzle plate for liquid ejector head according to the present invention has a nozzle hole for ejecting droplets composed of an ejection liquid, wherein the surface energy of an inner wall of the nozzle hole at 25° C. is lower than the surface tension of the ejection liquid at 25° C. and is substantially same as the surface energy of the ejection side surface of the nozzle plate at 25° C.

A liquid ejector head according to the present invention has a nozzle plate for liquid ejector head of the present invention and further has other components in accordance with the necessity.

A liquid ejector according to the present invention has at least a liquid ejector head of the present invention and further has other components in accordance with the necessity.

A liquid ejection method according to the present invention includes using at least a liquid ejector head of the present invention and further includes other steps in accordance with the necessity.

Hereinafter, the details of the liquid ejector and the liquid ejection method of the present invention will be clarified through the description of the nozzle plate for liquid ejector head and the liquid ejector head.

In the present invention, the surface energy of the inner wall of the nozzle hole at 25° C. is lower than the surface tension of the ejection liquid at 25° C., and the surface energy of the inner wall of the nozzle hole at 25° C. is substantially same as the surface energy of the ejection side surface of the nozzle plate at 25° C.

Specifically, a difference (B−A) of a surface tension (B) of the ejection liquid at 25° C. minus a surface energy (A) of the inner wall of the nozzle hole at 25° C. is preferably higher than 0 mN/m and equal to or lower than 10 mN/m, and more preferably 2 mN/m to 7 mN/m.

When the surface energy of the inner wall of the nozzle hole is higher than the surface tension of the ejection liquid, the ejection liquid may easily adhere to the inner wall of the nozzle hole to remain thereon. When the difference (B−A) is higher than 10 mN/m, it may adversely affect the filling property of the ejection liquid.

For the surface tension of the ejection liquid at 25° C., for example, when the ejection liquid is an ink and used at a temperature of 25° C., the surface tension is preferably 35 mN/m or less, and more preferably 25 mN/m to 30 mN/m.

When the surface energy of the inner wall of the nozzle hole at 25° C. is substantially same as the surface energy of the ejection side surface of the nozzle plate at 25° C., it is preferable in terms that the meniscus is easily controlled and the nozzle plate is easily prepared.

Note that the wording "substantially same" includes not only the case where the surface energy of the inner wall of the nozzle hole at 25° C. is the same as that of the ejection side surface of the nozzle plate but also includes the case where a difference therebetween is in the range from −2 mN/m to +2 mN/m.

The surface energy of the inner wall of the nozzle at 25° C. is preferably 25 mN/m or less. When the surface energy of the inner wall of the nozzle hole is 25 mN/m or less, the effects of the present invention are remarkably exhibited.

The surface energy of the inner wall of the nozzle hole and the surface energy of the nozzle plate surface are determined as follows. First, each of contact angles θ with respect to various types of liquid having a different surface tension is determined, next, a so-called "Zisman plot" is prepared for each liquid in which "cos θ" is plotted against a surface tension γ of the liquid, and a surface tension γc (critical surface tension) in the case where the cos θ is equal to 1 (θ=0) is determined, which is to be the surface energy of the solid (W. A. Zisman Ind. Eng. Chem., 55, No. 10, 18-38 (1963)).

The surface energy of the solid is inherent to a material but can be changed by modifying the surface of the material. Examples of a method of modifying the surface of a material to change the surface energy include (1) a method of modifying the surface of a solid by an oxidative treatment, plasma treatment, or the like, and (2) a method of combining materials each having a different surface energy. For the method (2) above, following methods are exemplified: a method of forming layers each having a different surface energy on a solid surface by coating, electrodeposition, or the like, and a method of adding materials each having a different surface energy into a solid serving as a base to thereby combine them.

The size, shape, the number of nozzle holes and the structure thereof in the nozzle plate for liquid ejector head are not particularly limited and may be suitably selected in accordance with the intended use, however, the size (diameter) of the nozzle hole is preferably 10 μm to 50 μm.

Examples of material used for the nozzle plate for liquid ejector head include stainless steal, nickel, iron-nickel alloys; inorganic materials such as silicon wafers and zirconium oxides; and resins such as polyimide and polypropylene.

On the surface of the nozzle plate for liquid ejector head, a water-repellent layer formed by using Ni/PTFE eutectoid, a silicone resin, or a fluorine-based water-repellency imparting agent is generally provided in order to improve the ejection stability and the wiping property.

In the present invention, the surface energy of the inner wall of the nozzle hole provided in the nozzle plate for liquid ejector head is defined by the surface tension of the ejection liquid, and when the surface energy of the nozzle plate surface is also adjusted in accordance with the surface energy of the inner wall of the nozzle hole, the effects of the present invention are more efficiently exhibited. That is, it is preferable that the inner wall of the nozzle hole be subjected to a treatment similar to that of the nozzle plate surface as necessary.

Of these, it is extremely effective that the inner wall of the nozzle hole is covered with a layer formed using any one of a silicone resin and a fluorine-based water-repellency imparting agent.

The silicone resin is an organopolysiloxane that has a basic skeleton of a siloxane bond between Si and O and organic groups at the side chains thereof.

For such a silicone resin, a room-temperature curable liquid silicone resin is preferably used, and a silicone resin accompanied by hydrolysis reaction is more preferably used. For example, SR2411 manufactured by DOW CORNING TORAY SILICONE CO., LTD. is exemplified.

A method of forming the silicone resin layer is not particularly limited and may be suitably selected in accordance with the intended use. For example, a method is exemplified in which a liquid silicone solution or dispersion is poured into the nozzle hole to thereby coat the inner wall of the nozzle hole. When a silicone resin layer is formed on the inner wall of the nozzle hole, besides the electrodeposition method, there is a method in which portions unnecessary to be covered with a silicone resin layer such as the back surface of the nozzle plate are masked with a photo resist, a water-soluble resin or the like, a silicone resin layer is formed thereover and then the mask is peeled off and removed, thereby making it possible to form a silicone resin layer on only target portions.

The thickness of the silicone resin layer is preferably 0.1 μm to 5.0 μm. In view of precision of nozzle diameter, it is more preferably 0.5 μm to 2.0 μm.

The fluorine-based water-repellency imparting agent is not particularly limited and may be suitably selected in accordance with the intended use. Examples thereof include low-molecular weight materials and resins. Those disclosed in Japanese Patent Application Laid-Open (JP-A) Nos. 2002-145645, 9-286639, and 2000-94567 can be used. Of these, a modified perfluoropolyoxetane (OPTOOL DSX, manufactured by Daikin Industries, Ltd) is particularly preferable.

In the modified perfluoropolyoxetane, sites modified with silicone are chemically bonded to a support base, and therefore, when a hydroxyl group is contained in the support base, a layer having extremely high adhesion property can be formed.

For a method of forming an ink-repellent layer using the fluorine-based water-repellency imparting agent, vacuum evaporation method is exemplified besides methods similar to the forming method using a silicone resin.

The thickness of the layer composed of the fluorine-based water-repellency imparting agent is preferably 0.1 nm to 10 nm (1 angstrom to 100 angstroms), and more preferably 0.1 nm to 3 nm (1 angstrom to 30 angstroms).

The liquid ejector head of the present invention has at least the nozzle plate for liquid ejector head of the present invention and is equipped with a housing, an ink chamber, an energy generating unit, an ink channel, a controlling unit and the like, and is suitably used in the liquid ejector of the present invention.

The liquid ejector of the present invention has at least the liquid ejector head of the present invention and is used in printers, facsimiles, copiers, or complex machines thereof, various types of image forming apparatuses such as plotters or other various types of patterning devices, however, it is particularly preferably used in the inkjet recording apparatus and the inkjet recording method to be described hereinafter.

(Inkjet Recording Apparatus and Inkjet Recording Method)

The inkjet recording apparatus of the present invention has at least the liquid ejector of the present invention and further has other units such as a stimulus generating unit, and a controlling unit in accordance with the necessity, wherein an ink used as an ejection liquid is ejected from the liquid ejector to thereby record an image.

The inkjet recording method of the present invention includes at least the liquid ejection method of the present invention and further includes other steps such as a stimulus generating step and a controlling step, wherein an ink used as an ejection liquid is ejected by the liquid ejection method to thereby record an image.

The liquid ejector is a unit configured to apply a stimulus to the ink to fly the ink and to thereby form an image.

The liquid ejection method is a method in which a stimulus is applied to the ink, the ink is caused to fly, and an image is formed.

The stimulus can be generated through the use of the stimulus generating unit. The stimulus is not particularly limited and may be suitably selected in accordance with the intended use, and examples thereof include heat (temperature), pressure, vibration, and light. Each of these stimuli may be used alone or in combination with two or more. Of these, heat and pressure are preferably used.

Examples of the stimulus generating unit include a heating device, a pressurizing device, a piezoelectric element, an oscillation generating device, an ultrasonic sound oscillator, and light. Specific examples thereof include a piezoelectric actuator such as a piezoelectric element, a thermal actuator that uses a thermoelectric conversion element such as heat-generating resistor and employs phase transition caused by film boiling of a liquid, a shape memory alloy actuator that uses a metal phase transition caused by temperature variations, and an electrostatic actuator using electrostatic forces.

The ink flight mode is not particularly limited and it differs depending on the type of the stimulus used. For example, when the stimulus is "heat", thermal energy corresponding to a recording signal is imparted, for example with a thermal head or the like, to the ink located in the recording head, gas bubbles are generated in the ink by the thermal energy, and the ink is ejected as a droplet from a nozzle hole of the recording head by the pressure of the gas bubbles. Further, when the stimulus is "pressure", where a voltage is applied to a piezoelectric element adhesively bonded to a location called a pressure chamber inside the ink channel inside the recording head, the piezoelectric element is deflected, the volume of the pressure chamber is reduced, and the ink is ejected as a droplet from a nozzle hole of the recording head.

The size of the ink droplet that is caused to fly is preferably 3 pl to 40 pl, the ejection velocity is preferably 5 m/s to 20 m/s, the driving frequency is preferably 1 kHz or higher, and the resolution is preferably 300 dpi or higher.

The control unit is not particularly limited and may be suitably selected in accordance with the intended use as long as it can control the operations of each of the above-described units. For example, a device such as a sequencer or a computer can be used.

As an example of the liquid ejector of the present invention, one mode in which an inkjet head is used in an inkjet recording apparatus will be described below with reference to the appended drawings.

The inkjet recording apparatus includes any of inkjet recording apparatuses each equipped with an inkjet head such as a so-called "piezo-type inkjet head" in which a vibrating plate constituting the wall surface of an ink channel is deflected by using an piezoelectric element as a pressure generating unit that is configured to pressurize an ink contained in an ink channel, the volume inside the ink channel is changed to thereby eject ink droplets (see Japanese Patent Application Laid-Open (JP-A) No. 2-51734); a so-called "thermal-type inkjet head" in which an ink is heated with a thermal energy in an ink channel using a heat generating resistor to generate gas bubbles (see Japanese Patent Application Laid-Open (JP-A) No. 61-59911); and a so-called "electrostatic type inkjet head" in which a vibrating plate constituting the wall surface of an ink channel is placed at a position opposed to electrodes, the volume inside the ink channel is changed by deflecting the vibrating plate by an electrostatic force generated between the vibrating plate and the electrodes to thereby eject ink droplets (see Japanese Patent Application Laid-Open (JP-A) No. 6-71882). Of these, a piezo-type inkjet head that deflects a vibrating plate, and a thermal-type inkjet head that ejects droplets by a thermal energy are particularly preferable.

An ink jet recording apparatus shown in FIG. 1 has a main apparatus body 101, a paper feed tray 102 mounted on the main apparatus body 101 and serving to load paper, and a paper discharge tray 103 that is mounted on the main apparatus body 101 and serves for stocking the paper on which images have been recorded (formed). The top surface of an upper cover 111 of the main apparatus body 101 is a generally flat surface, a front surface 112 in the front cover of the main apparatus body 101 slopes obliquely backward with respect to the top surface, and on the downstream side of the sloping front surface 112, the paper discharge tray 103 and the paper feed tray 102 are provided so as to be projected forward (front side). Further, on one end side of the front surface 112, an ink cartridge loading unit 104 is provided at a location that is projected forward from the front surface 112 and is lower than the upper cover 111. A control panel 105 composed of control keys and a display is placed on the upper surface of the ink cartridge loading unit 104. The ink cartridge loading unit 104 has a front cover 115 that can be opened and closed to install and remove an ink cartridge.

Figure 2:
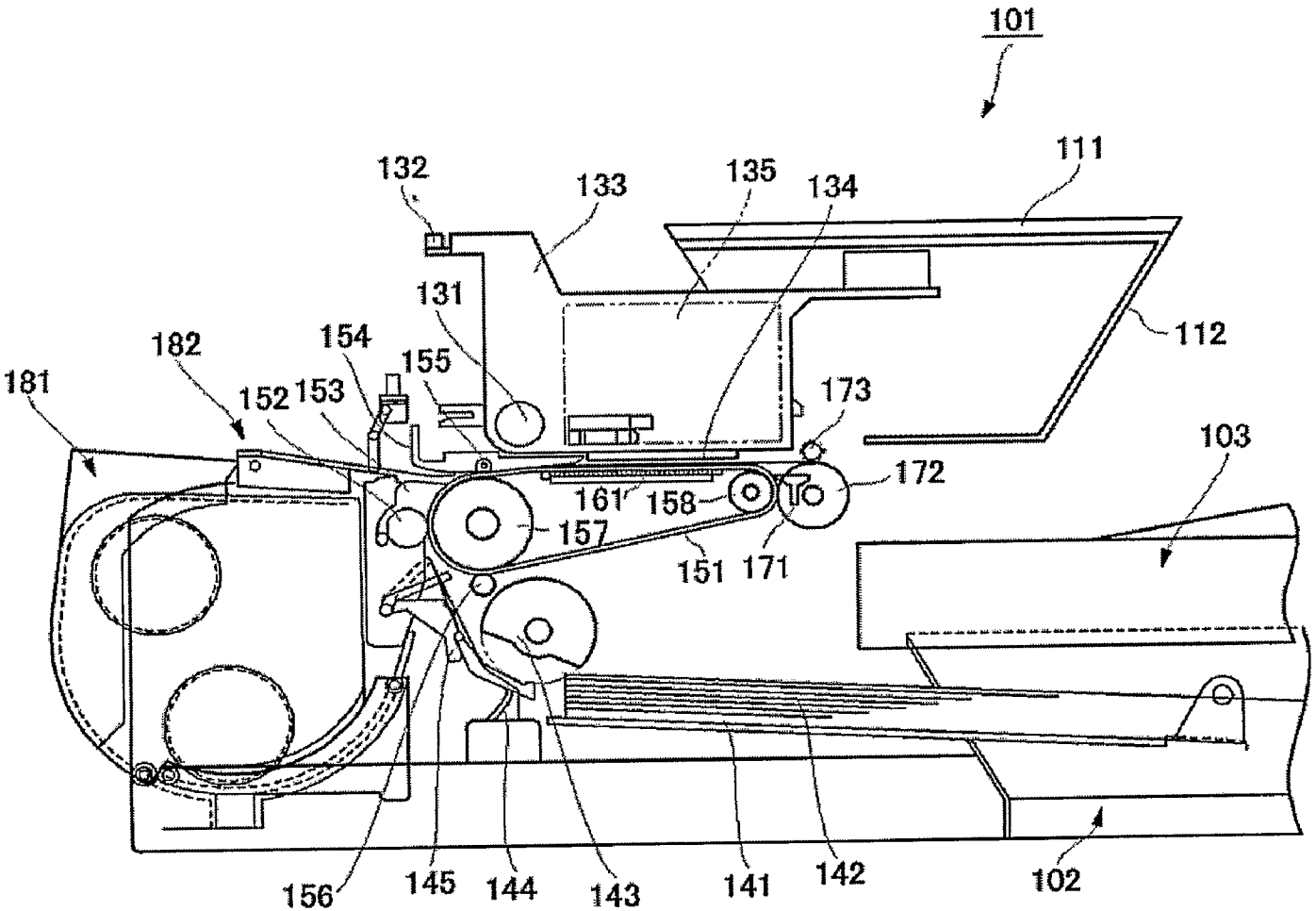
FIG. 2 is a schematic block diagram showing one embodiment of an inkjet recording apparatus according to the present invention.
Figure 3:
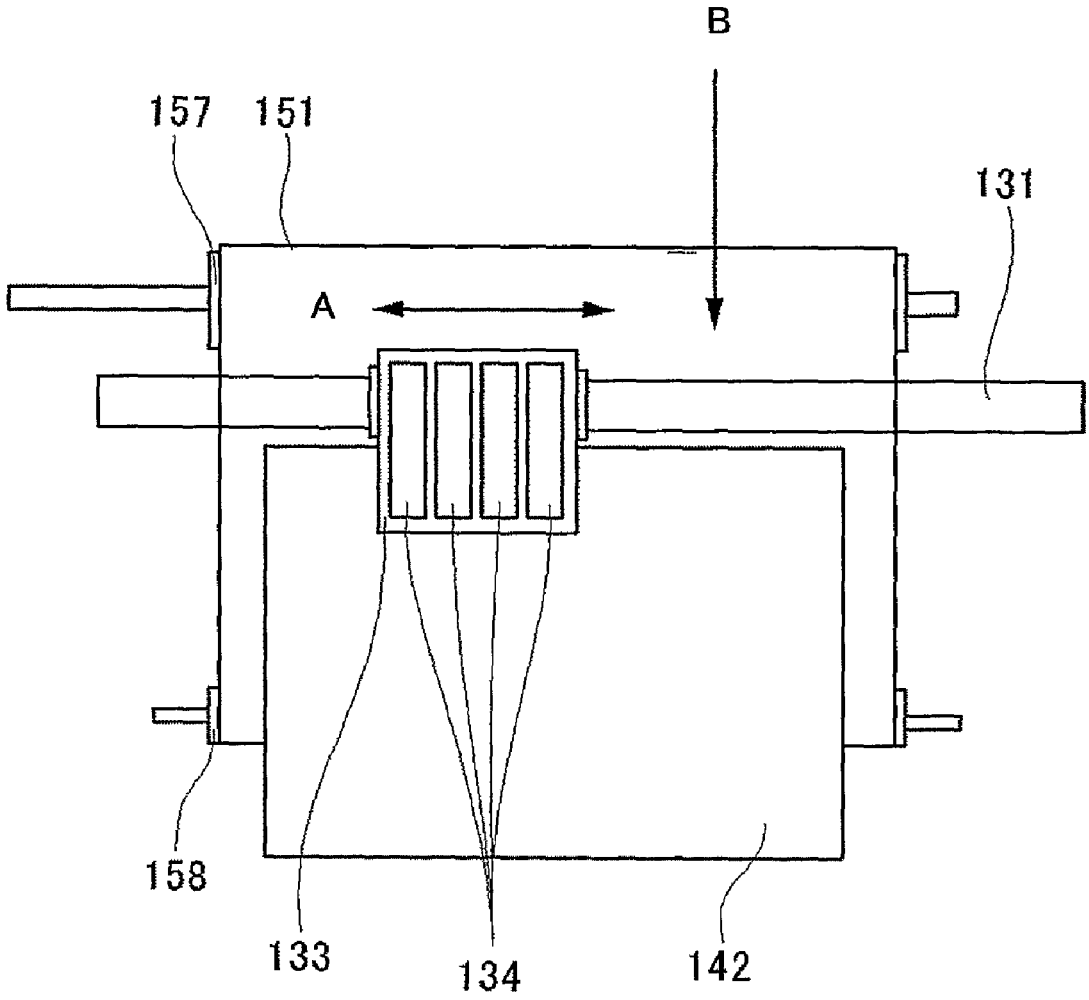
FIG. 3 is a schematic enlarged view showing one embodiment of an inkjet head in an inkjet recording apparatus according to the present invention.

Inside a main apparatus body 101, as shown in FIG. 2 and FIG. 3, a cartridge 133 is supported so that it can slide in a main scanning direction A by a guide rod 131 and a stay 132 that are guide members extending in the transverse direction between left and right side plates (omitted the figures), and the cartridge can be moved for scanning in the direction A shown by an arrow in FIG. 3 by a main scanning motor (not shown in the figure).

In the carriage 133, a recording head 134 composed of four heads for ink jet recording that eject ink droplets of yellow, cyan, magenta, and black colors is attached so that a plurality of ink ejection ports are arranged in the direction perpendicular to the main scanning direction A and the ink droplet ejection directions face downward.

As a head constituting the recording head 134, it is possible to use a unit equipped with, as an energy generating unit for ejecting the ink, a piezoelectric actuator such as a piezoelectric element; a thermal actuator that uses a thermoelectric conversion element such as heat-generating resistor and employs phase transition caused by film boiling of a liquid; a shape memory alloy actuator that uses a metal phase transition caused by temperature variations, or an electrostatic actuator using electrostatic forces.

The carriage 133 carries sub-tanks 135 for supplying inks of each color to the recording head 134. An ink is supplied via an ink supply tube (not shown in the figure) for replenishment to the sub-tank 135 from the ink cartridge that is loaded into the ink cartridge loading unit 104.

On the other hand, a half-moon roller (paper feed roller) 143 that can transport paper 142 sheet by sheet from a paper loading unit 141 and a separation pad 144 facing the paper feed roller 143 and made of a material with a high friction coefficient are provided as paper feed unit for feeding paper 142 that was loaded on the paper loading unit (pressure plate) 141 of the paper feed tray 102, and the separation pad 144 is biased toward the paper feed roller 143. A conveying belt 151 for electrostatically attracting the paper 142 and conveying it as a conveying unit for conveying the paper 142 fed from the paper feed unit at the downstream side of the recording head 134, a counter roller 152 for conveying the paper 142 conveyed from the paper feed unit via a guide 145 between the counter roller and the conveying belt 151, a conveying guide 153 that converts the direction of the paper 142 that is fed almost vertically upward by almost 90° to align the paper with the conveying belt 151, and a distal end pressure application roller 155 that is biased toward the conveying belt 151 with a pushing member 154 are provided as a conveying unit for conveying the paper 142 fed from the paper feed unit below the recording head 134. Further, a charging roller 156 is provided as a charging unit for electrically charging the surface of the conveying belt 151.

The conveying belt 151 is an endless belt that is stretched between a conveying roller 157 and a tension roller 158 and can rotate in a belt conveying direction B. The conveying belt 151, for example, has a surface layer serving as a paper attraction surface that is formed from a resin material with a thickness of about 40 μm that is not resistance controlled, for example, a copolymer of tetrafluoroethylene and ethylene (ETFE) and a back layer (medium resistance layer, ground layer) that is made of the same material as the resistance layer, but was resistance controlled with carbon. A guide member 161 is placed opposite a printing region created by the recording head 134 on the rear side of the conveying belt 151. A separation blade 171 for separating the paper 142 from the conveying belt 151, a paper discharge roller 172 and a paper discharge roller 173 are provided as a paper discharge unit for discharging the paper 142 that has been recorded in the recording unit 134. The paper discharge tray 103 is placed below the paper discharge roller 172. A two-side paper feed unit 181 is detachably mounted on the rear surface portion of the main apparatus body 101. The two-side paper feed unit 181 takes up the paper 142 returned by the rotation of the conveying belt 151 in the opposite direction, turns the paper over, and feeds the paper again between the counter roller 152 and the conveying belt 151. A manual paper feed unit 182 is provided on the upper surface of the two-side paper feed unit 181.

In the ink jet printing apparatus, the paper 142 is separated and fed sheet by sheet from the paper feed unit, the paper 142 that is fed along an almost vertical direction is guided by the guide 145, and squeezed and conveyed between the conveying belt 151 and the counter roller 152. The distal end of the paper is guided by the conveying guide 153 and pressed against the conveying belt 151 by the distal end pressure application roller 155, to convert the conveying direction thereof by almost 90°.

At this time, the conveying belt 151 is charged by the charging roller 156, and the paper 142 is electrostatically attracted to the conveying belt 151 and conveyed thereby. By driving the recording head 134 according to the image signal, while moving the carriage 133, ink droplets are ejected to record one line on the stopped paper 142, and the next line is recorded after the paper 142 has been conveyed through the predetermined distance. Once a recording end signal or a signal indicating that the rear end of the paper 142 has reached the recording region is received, the recording operation is stopped and the paper 142 is discharged to the paper discharge tray 103.

Where the ink near-end inside the sub-tank 135 is detected, the sub-tank 135 is replenished with the required amount of ink from the ink cartridge 201.

Figure 4:
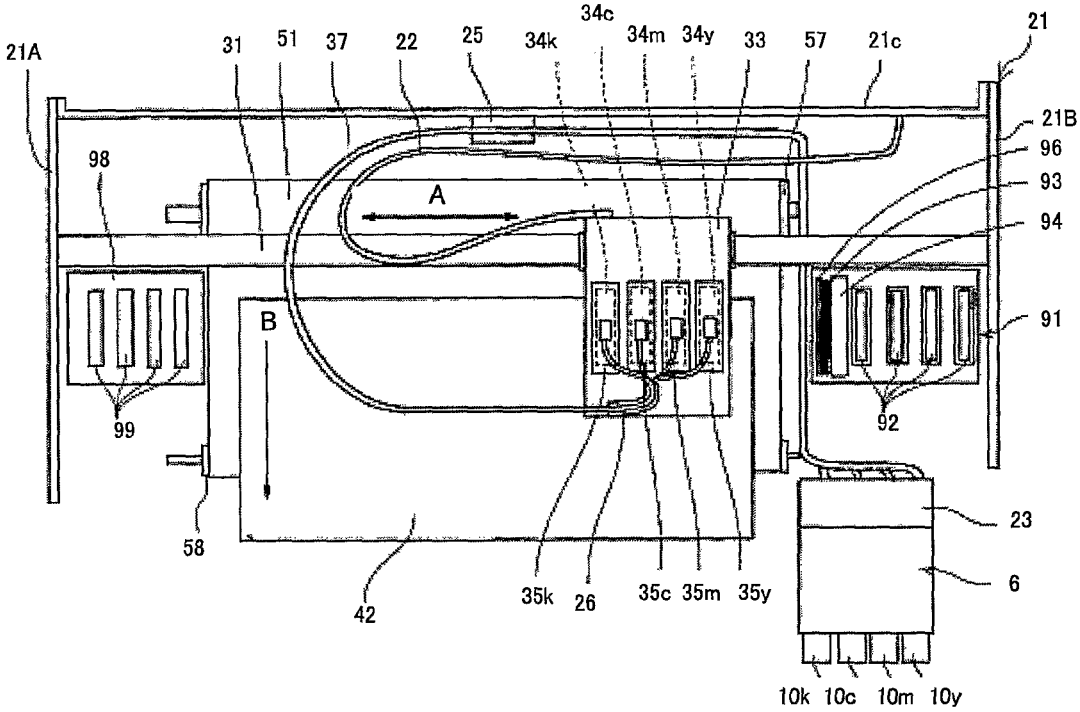
FIG. 4 is a schematic view showing one embodiment of an inkjet head in an inkjet recording apparatus according to the present invention and the periphery of the inkjet head.

Further, as shown in FIG. 4, in a non-printing region on one side of the inkjet recording apparatus in the scanning direction A of a carriage 33, a condition keeping unit 91 for keeping a condition for a nozzle of a recording head 34 and recovering the condition is placed. The condition keeping unit 91 is equipped with caps 92 for capping each of nozzle surfaces of the recording head 34, a wiper blade 93 for wiping the nozzle surfaces, blank ejection receivers 94 for receiving droplets that do not contribute to recording but eject a thickened recording liquid, a wiper cleaner 94 that is integrated with the blank ejection receiver 94 into one unit and serves as a cleaning member to remove recording liquid adhered to the wiper blade 93, a cleaner roller 96 constituting a cleaning unit that pushes the wiper blade 93 against the wiper cleaner 94 when the wiper blade 93 is cleaned, and the like. In the above-mentioned structure, when the recording head 34 will pass through the location of the wiper blade 93 and will be projected in the traveling route, the ejection port of the recording head 34 is to be wiped.

Next, one mode for implementing the inkjet recording method of the present invention with the inkjet head of the present invention will be explained below with reference to the appended drawings.

Figure 5:
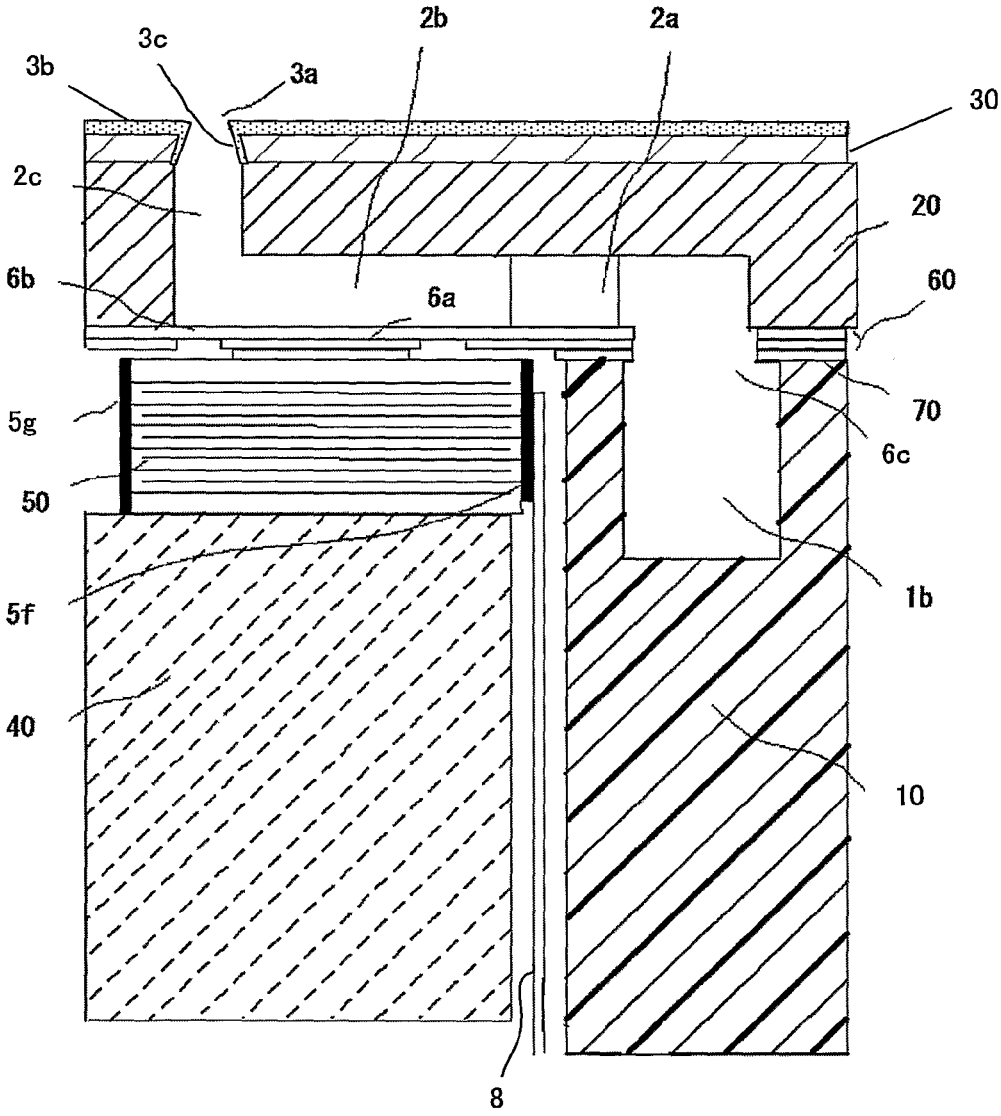
FIG. 5 is an enlarged view exemplarily showing elements of an inkjet head in the inkjet recording apparatus according to the present invention.
Figure 6:
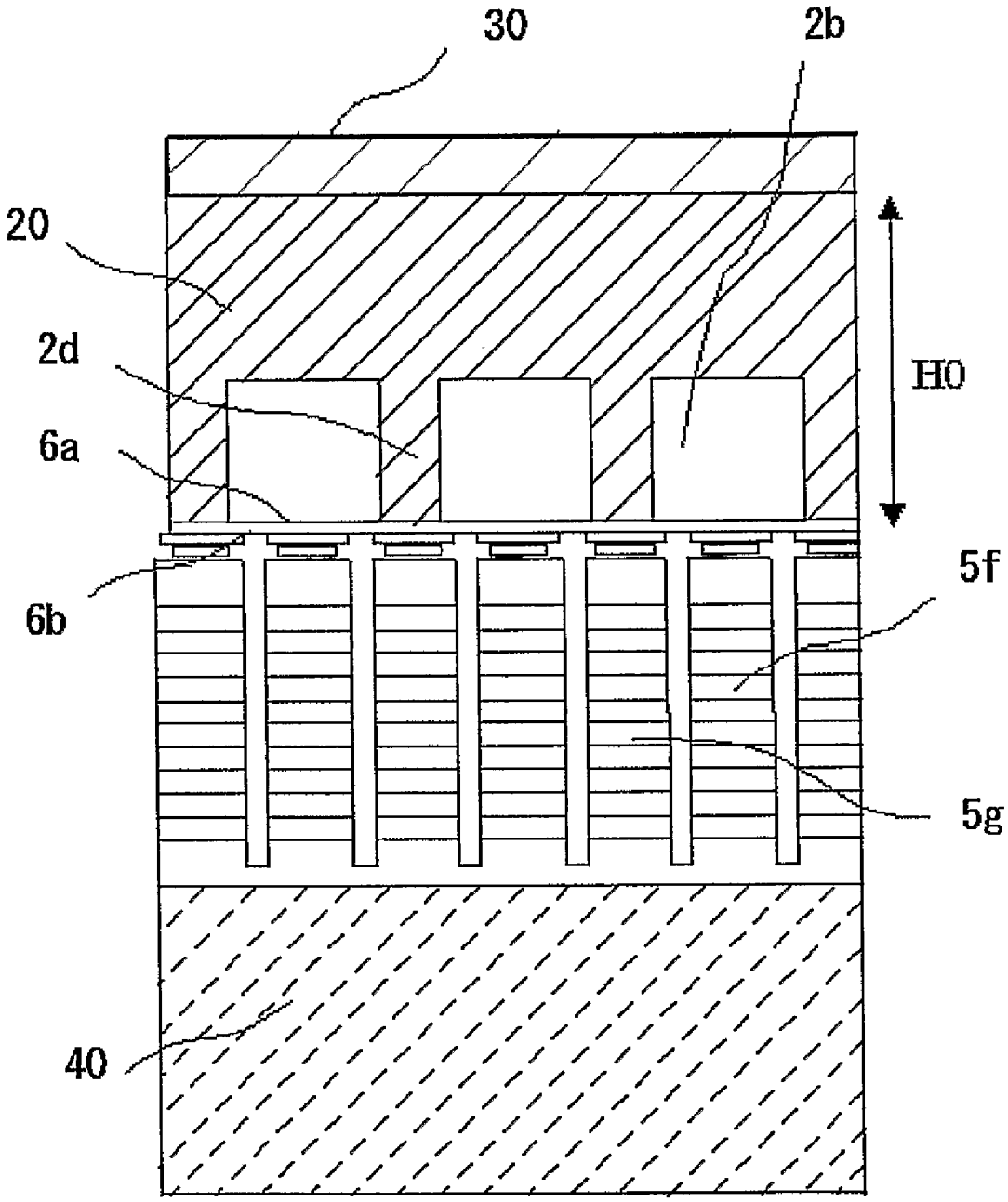
FIG. 6 is an enlarged view exemplarily showing elements in the inter-channel direction of an inkjet head in an inkjet recording apparatus according to the present invention.

FIG. 5 is an enlarged view exemplarily showing elements of an inkjet head according to one embodiment of the present invention. FIG. 6 is an enlarged view exemplarily showing elements in the inter-channel direction of the same inkjet head as in FIG. 5.

The inkjet head is provided with an ink supply port (not shown), a frame 10 with an engraved portion serving as a common liquid chamber 1*b* therein, a fluid resistance section 2*a*, an engraved portion serving as a pressurized liquid chamber 2*b*, a flow channel plate 20 formed with a communicating port 2*c* communicated with a nozzle 3*a*, a nozzle plate 30 forming the nozzle 3*a*, a diaphragm protrusion 6*a*, a diaphragm part 6*b*, a vibrating plate 60 having an ink flow-in port 6*c*, a laminated piezoelectric element 50 adhesively bonded via an adhesive layer 70 to the vibrating plate 60, and a base 40 holding the laminated piezoelectric element 50.

The base 40 is made of a barium titanate-based ceramic and is adhesively bonded to two rows of the laminated piezoelectric element 50 arranged thereon.

The laminated piezoelectric element 50 is formed in a laminate structure in which piezoelectric layers composed of lead zirconate titanate (PZT) and having a thickness of 10 μm/layer to 50 μm/layer and internal electrode layers composed of silver-palladium (AgPd) and having a thickness of several micrometers per layer are alternately laminated. The internal electrode layers are connected to external electrodes at both ends thereof.

The laminated piezoelectric element 50 is split in a two-sided comb form by half-cut dice processing and element pieces therein are used as a drive unit 5*f* and a supporting unit (non-drive unit) 5*g* on alternate teeth basis. The exterior side of the external electrodes is split by half-cut dice processing, the length of the electrodes is limited by cutting or the like, and these electrodes are to be a plurality of individual electrodes. The interior side of the external electrodes is conductive to be a common electrode without being split by dice processing.

The individual electrodes serving as driving unit are soldered and bonded with FPC 8. The common electrode is formed so as to wrap around an electrode layer formed at one end of the laminated piezoelectric element to be joined to Gnd electrode of the FPC 8. In the FPC 8, a driver IC (not shown) is mounted, thereby controlling application of a drive voltage to the drive unit 5*f*.

The vibrating plate 60 is formed so as to have an island protrusion part 6*a* (island part) that joins the thin-layer diaphragm section 6*b* and the laminated piezoelectric element 50 that is formed at the center of the diaphragm section 6*b* and becomes the driving part 5*f*, a thick film part including a beam bonded to the support section, and a port to be an ink flow-in port 6*c* by piling up two layers made of Ni-plated film by electrocasting. The diaphragm section 6*b* has a thickness of 3 μm and a width of 35 μm (single side).

The island protrusion part 6*a*, the driving part 5*f* of the laminated piezoelectric element, the vibrating plate 60 and the frame 10 are adhesively bonded by patterning an adhesive layer 70 containing gap materials.

The channel plate 20 is formed of a silicon single-crystal plate and patterned by etching treatment so as to form engraved portions of the fluid resistance section 2*a* and the pressurized liquid chamber 2*b* and a through hole that becomes the communicating port 2*c* at a position opposed to the nozzle 3*a*.

Portions remained unetched will be a partition wall 2*d* of the pressurized liquid chamber 2*b*. In this inkjet head, a portion formed with a narrow etching width is provided to use it as the fluid resistance section 2*a*.

The nozzle plate 30 is formed of a metal material such as an Ni plating film by electrocasting, and on the surface thereof, plural nozzles 3*a* are formed as microscopic ejection ports from which ink droplets fly.

The inside of the nozzle 3*a* is formed in a horn shape (generally cylindrical form or generally circular conic trapezoidal form), and a nozzle interior portion 3*c* indicates the inner wall. The diameter of the nozzle 3*a* is 20 μm to 35 μm when measured as a diameter of the ink droplet ejection side port. The nozzle pitch for each row is set to 150 dpi. On the ink ejection surface (the nozzle surface side) of the nozzle plate 30, an ink repellent layer 3*b* is formed which has been subjected to an ink repellent surface treatment.

For the ink repellent layer 3*b*, a resin layer formed of a fluorine resin, a silicone resin or the like and a metal/resin composite film such as an Ni/PTFE eutectoid film can be used. When a resin layer is employed, the effects of the present invention will be extremely conspicuously exhibited. Of these resin layers, a silicone resin layer is preferably used as the ink repellent layer.

The frame 10 formed with the ink supply port and the engraved portion for the common liquid chamber 1*b* is formed using a resin.

In the thus structured inkjet head, displacement of the driving part 5*f* in the laminating direction occurs by applying a drive waveform (pulse electric voltage of 10V to 50V) to the driving part 5*f* according to a recording signal, the pressurized liquid chamber 2*b* is pressurized via the vibrating plate 60, and the pressure is increased to thereby eject an ink droplet from the nozzle 3*a*.

Upon completion of ejection of an ink droplet, the pressure of the ink inside the pressurized liquid chamber 2*b* is reduced, a negative pressure occurs inside the pressurized liquid chamber 2*b* due to the inertia of ink flow and the electric discharge process of driving pulse, and the process proceeds to an ink filling process. At that time, the ink supplied from the ink tank flows in the common liquid chamber 1*b*, passes from the common liquid chamber 1*b* to the fluid resistance section 2*a* through the ink flow-in port 6*c* and is fed in the pressurized liquid chamber 2*b*.

The fluid resistance section 2*a* has an effect on attenuation of residual pressure vibration after the ejection of ink droplets but becomes resistant to refilling by the surface tension. The attenuation of the residual pressure and the refilling time can be balanced by optionally selecting the fluid resistance section, and the time period (driving cycle) required until the inkjet head proceeds to a subsequent operation for ejecting an ink droplet can be shortened.

<Ink>

The ink contains, for example, a colorant, a resin, a wetting agent and a fluorochemical surfactant and further contains other components in accordance with the necessity.

—Colorant—

The colorant is not particularly limited and may be suitably selected from among those known in the art, however, pigments are more preferably used.

The pigment is not particularly limited and may be suitably selected in accordance with the intended use. For example, it may be an inorganic pigment or an organic pigment.

Examples of the inorganic pigment include titanium oxide, iron oxide, calcium carbonate, barium sulfate, aluminum hydroxide, barium yellow, cadmium red, chrome yellow, and carbon black.

Examples of the organic pigment include azo pigment, polycyclic pigment, dye chelate, nitro pigment, nitroso pigment, and aniline black. Of these, azo pigment and polycyclic pigment are more preferably used.

Examples of the azo pigments include azolake pigments, insoluble azo pigments, condensed azo pigments, and chelate azo pigments.

Examples of the polycyclic pigment include phthalocyanine pigment, perylene pigment, perynone pigment, anthraquinone pigment, quinacridone pigment, dioxazine pigment, indigo pigment, thioindigo pigment, isoindolinone pigment, and quinofuraron pigment.

Examples of the dye chelate include basic dye chelate, and acidic dye chelate.

Color of the colorant is not particularly limited and may be suitably selected in accordance with the intended use. For example, colorants for black ink and colorants for color ink are exemplified. These colorants may be used alone or in combination with two or more.

Examples of colorants for black ink include carbon black (C.I. Pigment Black 7) colorants such as furnace black, lamp black, acetylene black, and channel black; metal powders such as copper, iron (C.I. Pigment Black 11), and titanium oxide; and organic pigments such as aniline black (C.I. Pigment Black 1).

For the carbon black, a carbon black produced by furnace method or channel method and having a primary particle diameter of 15 nm to 40 nm and a specific surface measured by BET method of 50 $m^2/g$ to 300 $m^2/g$, a DBP oil absorption of 40 mL/100 g to 150 mL/100 g, a volatile matter content of 0.5% to 10% and a pH value of 2 to 9 is preferably used. Specific examples of such a carbon black include No. 2300, No. 900, MCF-88, No. 33, No. 40, No. 45, No. 52, MA7, MA8, MA100, and No. 2200B (all manufactured by Mitsubishi Chemical Corporation); RAVEN 700, RAVEN 5750, RAVEN 5250, RAVEN 5000, RAVEN3500, and RAVEN 1255 (all manufactured by Columbia Co.); REGAL 400R, REGAL 330R, REGAL 660R, MOGUL L, MONARCH 700, MONARCH 800, MONARCH 880, MONARCH 900, MONARCH 1000, MONARCH 1100, MONARCH 1300, and MONARCH 1400 (all manufactured by CABOT Corp.); and Color Black FW1, FW2, FW2V, FW18, FW200, Color Black S150, S160, S170, PRINTEX 35, PRINTEX U, PRINTEX V, PRINTEX 140U, PRINTEX 140V, Special Black 6, Special Black 5, Special Black 4A, and Special Black 4 (all manufactured by Degssa Co.).

Pigments used for colorants for yellow ink are not particularly limited and may be suitably selected in accordance with the intended use. Examples thereof include C.I. Pigment Yellow, 1, 2, 3, 12, 13, 14, 16, 17, 73, 74, 75, 83, 93, 95, 97, 98, 114, 120, 128, 129, 138, 150, 151, 154, 155, 174, and 180.

Pigments used for colorants for magenta ink are not particularly limited and may be suitably selected in accordance with the intended use. Examples thereof include C.I. Pigment Red 5, 7, 12, 48 (Ca), 48 (Mn), 57 (Ca), 57:1, 112, 122, 123, 146, 168, 176, 184, 185, 202, and Pigment Violet 19.

Pigments used for colorants for cyan ink are not particularly limited and may be suitably selected in accordance with the intended use. Examples thereof include C.I. Pigment Blue 1, 2, 3, 15, 15:3, 15:4, 15:34, 16, 22, 60, 63, 66, C.I. Vat Blue 4, and C.I. Vat Blue 60.

Besides the above pigments, it is possible to use a self-dispersible pigment that is dispersible in water by adding a functional group such as sulfone group and carboxyl group to the surface of a pigment (for example, carbon). The pigment may be a pigment that is capsulated in a microcapsule and is dispersible in water, that is, a resin fine particle containing pigment particles. In this case, all the pigment particles blended in an ink are not necessarily encapsulated in or absorbed in resin fine particles, and the pigment may be dispersed in an ink within the range where the effects of the present invention are not impaired.

The particle diameter of the pigment is not particularly limited and may be suitably selected in accordance with the intended use. The most frequent particle diameter in the number distribution of particle size is preferably 20 nm to 150 nm. When the particle size is larger than 150 nm, not only the dispersion stability of the ink pigment degrades but also the ejection stability degrades, which may cause degradation of image quality such as image density. In contrast, when the particle size is smaller than 20 nm, the storage stability of the ink and the jetting property in a printer are kept stable, however, when pigment particles are dispersed in such a small particle size, operations for dispersion and classification are complicated, and it may be difficult to produce an ink at low cost. When the pigment is dispersed using the dispersing agent, conventional dispersing agents can be used without any particular limitation. Examples thereof include polymer dispersing agents and water-soluble surfactants.

The content of the pigment in the ink is preferably 0.5% by mass to 25% by mass, and more preferably 2% by mass to 15% by mass. Generally, when the pigment concentration is high, the image density is increased and the image quality is improved, however, it tends to adversely affect reliabilities of fixing property, ejection stability, clogging and the like.

—Wetting Agent—

When a wetting agent is contained in an ink, water retentivity and wettability of the ink can be ensured. As a result, even when the ink is stored for a long period of time, it is possible to realize an ink having excellent storage stability without causing flocculation of colorants therein and an increase in viscosity thereof. Further, it is possible to realize an ink capable of maintaining flowability of dry matters for a long period of time even when a nozzle used is set open at the nozzle tip. Furthermore, high ejection stability can be obtained without causing nozzle clogging when the printer is restarted during printing process or after discontinuation of printing process.

The wetting agent is not particularly limited and may be suitably selected in accordance with the intended use. Examples thereof include polyhydric alcohols, polyhydric alcohol alkyl ethers, polyhydric alcohol aryl ethers, nitrogen-containing heterocyclic compounds, amides, amines, sulfur-containing compounds, propylene carbonate, and ethylene carbonate. These wetting agents may be used alone or in combination with two or more.

Examples of the polyhydric alcohols include ethylene glycol, diethylene glycol, triethylene glycol, polyethylene glycol, propylene glycol, dipropylene glycol, tripropylene glycol, polypropylene glycol, 1,3-propanediol, 1,3-butanediol, 2,3-butanediol, 1,4-butanediol, 3-methyl-1,3-butanediol, 1,5-pentanediol, 1,6-hexanediol, 2-methyl-2,4-pentanediol, tetraethylene glycol, polyethylene glycol, glycerine, 1,2,6-hexanetriol, 1,2,4-butanetriol, 1,2,3-butanetriol, and petriol.

Examples of the polyhydric alcohol alkyl ethers include ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether.

Examples of the polyhydric alcohol aryl ethers include ethylene glycol monophenylether, and ethylene glycol monobenzyl ether.

Examples of the nitrogen-containing heterocyclic compounds include N-methyl-2-pyrrolidone, N-hydroxyethyl-2-pyrrolidone, 2-pyrrolidone, 1,3-dimethylimidazolidinone, and ϵ-caprolactam.

Examples of the amides include formaldehyde, N-methyl formaldehyde, and N,N-dimethyl formamide.

Examples of the amines include monoethanolamine, diethanolamine, triethanolamine, monoethylamine, diethylamine, and triethylamine.

Examples of the sulfur-containing compounds include dimethylsulfoxide, sulfolane, thiodiethanol, and thiodiglycol.

Of these, 1,3-butyl glycol, diethylene glycol, triethylene glycol, and glycerine are particularly preferable in that they can prevent clogging caused by dry of ink and improve the chroma saturation of images.

The content of the wetting agent in the ink is preferably 0.1% by mass to 50% by mass, and more preferably 5% by mass to 40% by mass.

—Surfactant—

The surfactant can be added to the ink as necessary for the purpose of improving the ink ejection stability, because the use of surfactant allows for controlling the dispersion stability of colorants and the surface tension of the ink to thereby improve the permeability to a recording medium used and the wettability of the ink. In particular, when a fluorochemical surfactant is used, an effect that reduces the surface tension of the ink and enhances the wettability to paper thereby improving the color developing property of the ink is largely exerted, but the meniscus holding force is reduced due to the increased wettability to the inner wall of the nozzle hole, and the nozzle becomes brittle. Whereas, when the nozzle plate of the present invention is used, such a problem can be avoided.

Examples of the fluorochemical surfactant include perfluoroalkyl sulfonate, perfluoroalkyl carboxylate, perfluoroalkyl phosphate ester, perfluoroalkyl ethylene oxide adducts, perfluoroalkyl betaine, and perfluoroalkyl amine oxide compounds.

For the fluorochemical surfactant, commercially available products can be used. Specific examples thereof include SURFRON S-111, S-112, S-113, S121, S131, S132, S-141, and S-145 (manufactured by Asahi Glass Co.); FRORARD FC-93, FC-95, FC-98, FC-129, FC-135, FC-170C, FC-430, FC-431, and FC-4430 (manufactured by Sumitomo 3M Ltd.); MEGAFAC F-470, F1405, and F474 (manufactured by Dainippon Ink and Chemicals, Inc.); ZONYL FS-300, FSN, FSN-100, and FSO (manufactured by DuPont Co.); and EFTOP EF-351, 352, 801, and 802 (manufactured by Jemco Inc.). Of these, ZONYL FS-300, FSN, FSN-100 and FSO (manufactured by DuPont Co.) are particularly preferable in terms of reliability and enhancement of color developing property.

These fluorochemical surfactants may be used alone or in combination with two or more. Further, these fluorochemical surfactants may be mixed with different types of surfactant such as anionic surfactant, cationic surfactant and nonionic surfactant.

For the surfactant, besides the above-mentioned fluorochemical surfactants, an anionic surfactant, a cationic surfactant and a nonionic surfactant, an amphoteric surfactant and the like can be used. These surfactants may be used alone or in combination with two or more.

Examples of the anionic surfactants include alkylallyl or alkyl naphthalene sulfonate, alkyl phosphate, alkyl sulfate, alkyl sulfonate, alkyl ether sulfate, alkyl sulfosuccinate, alkyl ether sulfate, alkylbenzene sulfonate, alkyl diphenyl ether disulfonate, alkyl aryl ether phosphate, alkyl aryl ether sulfate, alkyl aryl ether sulfate, olefin sulfonate, alkane olefin sulfonate, polyoxyethylene alkyl ether phosphate, polyoxyethylene alkyl ether sulfate, ether carboxylate, sulfosuccinate, α-sulfo fatty acid ester, fatty acid salt, condensed products prepared between higher fatty acid and amino acid, and naphthenate.

Examples of the cationic surfactants include alkyl amin salt, dialkyl amine salt, aliphatic amine salt, benzalconium salt, quaternary ammonium salt, alkyl pyridinium salt, imidazolinium salt, sulfonium salt, and phosphonium salt.

Examples of the nonionic surfactants include polyoxyethylene alkyl ether, polyoxyethylene alkyl allyl ether, polyoxyethylene alkyl phenyl ether, polyoxyethylene glycol ether, polyoxyethylene fatty acid amide, polyoxyethylene fatty acid ester, polyoxyethylene polyoxypropylene glycol, glycerine ester, sorbitan ester, sucrose ester, polyoxyethylene ether of glycerine ester, polyoxyethylene ether of sorbitan ester, polyoxyethylene ether of sorbitol ester, fatty acid alkanol amide, amine oxide, polyoxyethylene alkyl amine, glycerine fatty acid ester, sorbitan fatty acid ester, polyoxyethylene sorbitan fatty acid ester, polyoxyethylene sorbitol fatty acid ester, and alkyl(poly)glycoxide.

Examples of the amphoteric surfactants include imidazoline derivatives such as imidazolinium betaine; and dimethyl alkyl lauryl betaine, alkyl glycine, and alkyldi(aminoethyl) glycine.

The content of the surfactant in the ink is preferably 0.01% by mass to 5.0% by mass, and more preferably 0.5% by mass to 3% by mass. When the content is less than 0.01% by mass, the effect of adding of the surfactant cannot be obtained, and when the content is more than 5.0% by mass, the permeability to a recording medium increases more than necessary, which may cause a reduction in image density and ink strike through to the recording medium.

—Resin—

The resin is added to the ink for the purposes of improving image fixing property, image quality, dispersibility of pigments and the like. When a resin is used, it adheres not only on the nozzle surface but also into the ink channel such as inner wall of the nozzle hole, and a residue of the resin is recognized. Therefore, to avoid the problem, it is effective to use the nozzle plate for ink head of the present invention.

The resin is not particularly limited and may be suitably selected in accordance with the intended use. Examples of the resin include hydrophilic high polymers, which may be natural or artificial products. Examples of the natural products include vegetable high molecular materials such as gum arabic, tragacanth gum, Goor gum, karaya gum, locust bean gum, arabinogalactone, pectin, or quince seed starch; marine algae based high polymers, such as alginic acid, carrageen or agar-agar; animal high polymers such as gelatine, casein, albumine or collagen; microbial high polymers such as xanthene gum or dextran. Examples of the artificial products include semisynthetic high polymers such as fibrous high polymers, e.g. methyl cellulose, ethyl cellulose, hydroxyethyl cellulose, hydroxy propyl cellulose, or carboxy methyl cellulose; starch-based high polymers such as sodium starch glycolate, or sodium starch phosphate; marine algae based high polymers such as sodium alginate or propylene glycol alginate; and pure synthetic high polymers such as polyacrylic acid, polymethacrylic acid, acrylic acid-acrylonitrile copolymer, vinyl acetate-acrylic ester copolymer, acrylic acid-acrylic alkyl ester copolymer, styrene-acrylic acid copolymer, styrene-methacrylic acid copolymer, styrene-acrylic acid-acrylic alkyl ester copolymer, styrene-methacrylic acid-acrylic alkyl ester copolymer, styrene-α-methylstyrene-acrylic acid copolymer, styrene-α-methylstyrene-acrylic acid copolymer, acrylic alkyl ester copolymer, styrene-maleic acid copolymer, vinylnaphthalene-maleic acid copolymer, vinyl acetate-ethylene copolymer, vinyl acetate-fatty acid vinylethylene copolymer, vinyl acetate-maleic ester copolymer, vinyl acetate-crotonic acid copolymer, vinyl acetate-acrylic acid copolymer or salts thereof.

The content of these resins in the ink can be appropriately adjusted in consideration of reliabilities of the image fixing property, image quality and dispersibility of pigments used.

Further, for the resin, instead of the resin that is soluble in a solvent, a resin emulsion can be used in which a resin is dispersed as fine particles in a solvent. In a resin emulsion, a resin fine particle is dispersed in a solvent as a continuous phase, and the resin emulsion may contain a dispersing agent such as surfactant in accordance with the necessity.

The resin fine particle is not particularly limited and may be suitably selected in accordance with the intended use. Examples thereof include acrylic resins, vinyl acetate resins, styrene resins, butadiene resins, styrene-butadiene resins, vinyl chloride resins, acryl styrene resins, and acryl-silicone resins. Of these, acryl-silicone resins are particularly preferable.

For the resin emulsion, commercially available products can be used. Specific examples thereof include MICROGEL E-100, E-2002, and E-5002 (styrene-acrylic resin emulsion, manufactured by Nippon Paint Co., Ltd.); BONCOAT 5454 (styrene-acrylic resin emulsion, manufactured by Dainippon Ink and Chemicals, Inc.); JOHNCRYL 775 (styrene-acrylic resin emulsion, manufactured by Johnson Polymer K.K.); SAE1014 (styrene-acrylic resin emulsion, manufactured by Nippon Zeon Company Limited); SAIBINOL SK-200 (acrylic resin emulsion, manufactured by Saiden Chemical Industry Co., Ltd.); PRIMAL AC-22, and AC-61 (acrylic resin emulsion, manufactured by Rohm and Haas Co.); NANOCRYL SBCX-2821, and NANOCRYL SBCX-3689 (acrylic silicone resin emulsion, manufactured by Toyo Ink Mfg. Co., Ltd.), and #3070 (methyl methacrylate polymer resin emulsion, manufactured by Mikuni Color Ltd.).

The content of the resin fine particle in the resin emulsion is preferably 10% by mass to 70% by mass.

The average particle diameter of the resin fine particle is preferably 10 nm to 1,000 nm, and more preferably 20 nm to 300 nm.

The content of the resin fine particle in the ink is preferably 0.1% by mass to 50% by mass, more preferably 0.5% by mass to 20% by mass, and still more preferably 1% by mass to 10% by mass.

Besides a state where the resin fine particle and a colorant are separately dispersed in the ink, the resin fine particle can be used in a state where the resin fine particle contains a water-insoluble or poorly water soluble colorant. The description "state where the resin fine particle contains a colorant" means a state where a colorant is encapsulated in the resin fine particle and/or a state where a colorant is absorbed to the surface of the resin fine particle. The description "water-insoluble or poorly water soluble" means that 10 parts by mass or more of a colorant cannot be dissolved to 100 parts by mass of water at a temperature of 20° C., and the word "dissolved" means that separation and/or precipitation of a colorant cannot be visually observed at the surface layer or the bottom layer of the aqueous solution.

When a colorant is encapsulated in the resin fine particle, the content of the resin fine particle in the ink is preferably 2% by mass to 30% by mass, because colorant components are contained therein.

The other components are not particularly limited and may be suitably selected in accordance with the necessity. Examples of the other components include pH adjustor, antiseptic-antifungal agent, chelate reagent, corrosion inhibitor, antioxidant, ultraviolet absorbent, oxygen absorbent and light stabilizer.

The pH adjustor is not particularly limited and may be suitably selected in accordance with the intended use as long as it can adjust the pH to a desired value without adversely affecting the ink to be prepared. Examples of the pH adjustor include alkali metal hydroxides such as lithium hydroxide, sodium hydroxide, and potassium hydroxide; alkali metal carbonates such as lithium carbonate, sodium carbonate, potassium carbonate; amines such as quaternary ammonium hydroxide, dimethanol amine, and triethanol amine; ammonium hydroxide, and quaternary phosphonium hydroxide.

Examples of the antiseptic-antifungal agent include 1,2-benzisothiazoline-3-one, sodium benzoate, dehydrosodium acetate, sodium sorbate, sodium pentachlorophenol, 2-pyridinetiol-1-sodium oxide. Examples of the corrosion inhibitor include acidic sulfite, sodium thiosulfate, anmone thioglycolate, diisopropylammoniumnitrite, pentaerythritol tetranitrate, and dicyclohexyl ammoniumnitrite.

Examples of the chelate reagent include ethylenediamine sodium tetraacetate, nitrilo sodium triacetate, hydroxyethyl ethylenediamine sodium triacetate, diethylene triamine sodium pentaacetate, and uramil sodium diacetate.

Examples of the corrosion inhibitor include acidic sulfite, sodium thiosulfate, anmone thioglycolate, diisopropyl ammoniumnitrite, pentaerythritol tetranitrate, dicyclohexyl ammoniumnitrite, and benzotriazole.

Examples of the antioxidant include phenol antioxidants (including hindered phenol antioxidants), amine antioxidants, sulfur antioxidants, and phosphorous antioxidants.

The ink is prepared by dispersing or dissolving a colorant, a resin, a wetting agent and a fluorochemical surfactant in an aqueous medium and further stirring and mixing the components in accordance with the necessity. The components can be dispersed by means of a sand mill, homogenizer, ball mill, paint shaker, ultrasonic dispersing device or the like. The stirring and mixing can be carried out by means of a stirring device using conventional stirring blades, magnet stirrer, high-speed dispersing device or the like.

The viscosity of the ink at 25° C. is preferably 5.0 mPa·s or more, and more preferably 6 mPa·s to 10 mPa·s. With an increase in viscosity of the ink to a higher viscosity of 5 mPa·s or more, the adhesiveness of the ink to the inner wall of the nozzle hole is increased. Thus, it is effective to use the nozzle plate of the present invention.

The present invention can solve the above-mentioned conventional problems and can provide a nozzle plate for liquid ejector head and a liquid ejector head each of which is provided with filling property, ejection stability and reliability, and a liquid ejector, a liquid ejection method each of which uses the nozzle plate and the liquid ejector head, as well as an inkjet recording apparatus and an inkjet recording method.

EXAMPLES

Hereinafter, embodiments of the present invention will be further described, however, the embodiments of the present invention are not limited thereto. In the following Examples and Comparative Examples, embodiments are shown in which a liquid ejector having the nozzle plate for liquid ejector head of the present invention is used in an inkjet recording apparatus.

Further, in the following Examples and Comparative Examples, the surface energy of the nozzle surface and an inner wall of a nozzle hole, the surface tension of an ink, and the viscosity of an ink were measured as follows.

<Surface Energy of Nozzle Surface and Inner Wall of Nozzle Hole>

The surface energy of the nozzle surface and the surface energy of an inner wall of a nozzle hole were measured using a sample that had been separately prepared on an aluminum flat plate in the same conditions as in the Examples and Comparative Examples described below, and surface tension test solutions having a different surface tension (manufactured by Junsei Chemical Industries). First, the contact angle between the sample and one of the surface tension test solutions was measured using a contact angle meter (OCA20, manufactured by Dataphsics), and a Zisman plot was constructed. Then, a surface tension $\gamma c$ (critical surface tension) at which $\cos\theta$ was equal to 1 ($\theta=0$), i.e., a surface energy, was determined.

<Surface Tension of Ink>

The surface tension of an ink was measured at 25° C. using an automatic surface tension measuring device (CBVP-Z, manufactured by Kyowa Interface Science Co., Ltd.).

<Viscosity of Ink>

The viscosity of an ink was measured at 25° C. using an R-type viscometer (RC-500, manufactured by Toki Sangyo Co., Ltd.).

Example 1

A nozzle surface formed by Ni-electrocasting and an inner wall of a nozzle hole were coated with a silicone resin (SR-2411, manufactured by DOW CORNING TORAY SILICONE CO., LTD.) using a dispenser and then subjected to a heat treatment in the atmosphere at 250° C. for 1 hour to form a silicone resin layer having a thickness of 0.5 μm (surface energy: 23.9 mN/m at 25° C.) on the nozzle surface and the inner wall of the nozzle hole. Note that a masking tape was previously affixed to the nozzle back surface formed by Ni electrocasting such that the silicone resin layer did not wrap around the nozzle back surface that was to be bonded to a head by peeling off the masking tape after forming the silicone resin on the nozzle surface and the inner wall of the nozzle hole, thereby forming a nozzle plate.

<Preparation of Black Ink>

Into 3,000 mL of a sodium sulfate solution of 2.5N (as defined), 90 g of carbon black having a CTAB specific surface area of 150 $m^2/g$ and a DBP oil absorption of 100 mL/100 g was added and stirred at a temperature of 60° C. and at 300 rpm to be reacted under oxidation treatment for 10 hours. The reactant solution was filtered, and the separately filtered carbon black was neutralized with sodium hydroxide, thereby performing an ultrafiltration treatment. The obtained carbon black was washed with water, dried and then dispersed in pure water so that the pigment concentration was 20% by mass, thereby preparing a surface-treated carbon black dispersion.

The following ink composition was mixed with the obtained carbon black dispersion, stirred, and then the mixture was filtered through a polypropylene filter having a pore diameter of 0.8 μm to thereby prepare a black ink with a viscosity of 7.6 mPa·s (25° C.) and a surface tension of 26.0 mN/m (25° C.).

—Ink Composition—

| | |
|---|---|
| carbon black dispersion | 45 parts by mass |
| acrylic silicone resin emulsion (NANOCRYL SBCX-2821, manufactured by Toyo Ink Mfg. Co., Ltd.) | 8 parts by mass |
| 1,3-butanediol | 18 parts by mass |
| glycerine | 6 parts by mass |
| fluorochemical surfactant (FS-300, manufactured by DuPont Co.) | 2 parts by mass |
| ion exchange water | 21 parts by mass |

Next, a head using the prepared nozzle plate was mounted to inkjet printers shown in FIG. 1 to FIG. 4 (IPSIO G707, manufactured by Ricoh Company Ltd.). Next, the filling property, ejection stability and shelf property were evaluated using the prepared black ink as follows. Table 1 shows the evaluation results.

<Evaluation 1: Filling Property>

The ink was sucked with a pump from the front surface of the nozzle, and the nozzle was filled with the ink from a supply port. At that time, 2 mL of ink, an amount more than the inside volume of the flow channel of the head, was sucked. Subsequently, an image was printed, and the percentage of the number of nozzles incapable of ejecting ink droplets was used for evaluation, and the results were evaluated based on the following criteria.

[Evaluation Criteria]

A: Among all nozzles used, there was no nozzle incapable of ejecting ink droplets.

B: Among all nozzles used, the percentage of the number of nozzles incapable of ejecting ink droplets was less than 1%.

C: Among all nozzles used, the percentage of the number of nozzles incapable of ejecting ink droplets was 1% or more and less than 5%.

D: Among all nozzles used, the percentage of the number of nozzles incapable of ejecting ink droplets was 5% or more.

<Evaluation 2: Ejection Stability>

All the nozzles were filled with the ink, and the state where no abnormal image occurred was confirmed. Then, an intermittent printing test was performed under the following conditions, and the results were evaluated based on the following criteria.

—Intermittent Printing Test—

After continuously printing 20 sheets of a print pattern chart to be described below, the printing operation was stopped to be in a rest state for 20 minutes, and this process was repeated 50 times, thereby printing 1,000 sheets in all. Then, one more sheet of the same chart was printed, and presence or absence of white voids, streaks and disturbed jetting was visually checked, and the results were evaluated based on the following criteria. The print sheet was printed at a recording density of 360 dpi in one-pass printing mode.

—Print Pattern—

The print pattern was printed with a pattern chart with a print area of 5% for each color ink with respect to the entire area of the paper sheet with each of the color inks at 100% duty.

[Evaluation Criteria]

A: There was no white void, streaks and disturbed jetting observed on the solid part of the image.

B: No white void found, but a slight amount of streaks and disturbed jetting was observed on the solid part of the image.

C: White voids, streaks and disturbed jetting were partly observed on the solid part of the image.

D: White voids, streaks and disturbed jetting were observed throughout the solid part of the image.

<Evaluation 3: Shelf Property>

All the nozzles were filled with the ink, and the state where no abnormal image occurred was confirmed. Then, the head was capped with a moisturizing cap in the inkjet printers shown in FIG. 1 to FIG. 4 (IPSIO G707, manufactured by Ricoh Company Ltd.). The inkjet printers were left intact under the conditions of a temperature 50° C. and a relative humidity of 60% for one month. Thereafter, the chart was printed again to determine the number of cleaning times until the printed image returned to the initial state where no white void and jetting distortion was found, and the results were evaluated based on the following criteria.

[Evaluation Criteria]

A: It was possible to obtain an image that was equivalent in quality to the initial image without performing cleaning.

B: The quality of the printed image recovered as in the initial state by cleaning the head once or two times.

C: The quality of the printed image recovered as in the initial state by cleaning the head three times or more.

D: The quality of the printed image did not recover equivalently to the initial state even after cleaning the head many times.

Example 2

A nozzle surface formed by Ni-electrocasting and the inner wall of the nozzle hole were coated with a silicone resin (SR-2411, manufactured by DOW CORNING TORAY SILICONE CO., LTD.) using a dispenser, and then subjected to a heat treatment in the atmosphere at 250° C. for 1 hour to form a silicone resin layer having a thickness of 0.5 μm (surface energy: 22.9 mN/m at 25° C.) on the nozzle surface and the inner wall of the nozzle hole. Note that a masking tape was previously affixed to the nozzle back surface formed by Ni electrocasting such that the silicone resin layer did not wrap around the nozzle back surface that was to be bonded to a head by peeling off the masking tape after forming the silicone resin on the nozzle surface and the inner wall of the nozzle hole, thereby forming a nozzle plate.

The filling property, ejection stability, and shelf property were evaluated in the same manner as in Example 1 except that a liquid ejector head using the thus prepared nozzle plate and a black ink prepared as follows were used. Table 1 shows the evaluation results.

<Preparation of Black Ink>

The following ink composition was mixed with a carbon black dispersion (sulfone group-added self-dispersible type, manufactured by Cabot Corp.), stirred, and then the mixture was filtered through a polypropylene filter having a pore diameter of 0.8 μm to thereby prepare a black ink with a viscosity of 8.5 mPa·s (25° C.) and a surface tension of 29.7 mN/m (25° C.).

—Ink Composition—

| | |
|---|---|
| carbon black dispersion (CAB-O-JET 200, sulfone group-added type, manufactured by Cabot Corp.) | 45 parts by mass |
| acrylic silicone resin emulsion (NANOCRYL SBCX-2821, manufactured by Toyo Ink Mfg. Co., Ltd.) | 8 parts by mass |
| 1,3-butanediol | 18 parts by mass |
| glycerine | 9 parts by mass |
| surfactant [$CH_3(CH_2)_{12}O\ (CH_2CH_2O)_3CH_2COOH$] | 1 part by mass |
| ion exchange water | 19 parts by mass |

Example 3

A polyimide film (manufactured by DuPont Co.; trade name: CAPTON, no particle added) was processed to form a nozzle hole by using an excimer laser. Then, on the polyimide film surface at the ejection side of the nozzle hole and the inner wall of the nozzle hole, an $SiO_2$ layer having a thickness of 1 nm (10 angstroms) was formed by sputtering, and then a layer of modified perfluoropolyoxetane (OPTOOL DSX, manufactured by Daikin Industries, Ltd.) having a thickness of 3 nm (30 angstroms) (surface energy: 21.7 mN/m at 25° C.) was formed by vacuum evaporation method, thereby preparing a nozzle plate.

The filling property, ejection stability, and shelf property were evaluated in the same manner as in Example 1 except that a liquid ejector head using the thus prepared nozzle plate and a cyan ink prepared as follows were used. Table 1 shows the evaluation results.

<Preparation of Cyan Ink>

A polymer fine particle dispersion containing a copper phthalocyanine pigment was prepared with reference to "Preparation Example 3" described in Japanese Patent Application Laid-Open (JP-A) No. 2001-139849.

First, a polymer solution was prepared as follows. First, the inside of a 1 L flask equipped with a mechanical stirrer, a thermometer, a nitrogen inlet tube, a reflux tube and a dripping funnel was sufficiently substituted by a nitrogen gas. Then, 11.2 g of styrene, 2.8 g of acrylic acid, 12.0 g of lauryl methacrylate, 4.0 g of polyethylene glycol methacrylate, 4.0 g of styrene macromer (trade name: AS-6, manufactured by TOAGOSEI CO., LTD.), 0.4 g of mercapto ethanol and 40 g of methylethylketone were poured into the flask, mixed, and the temperature of the mixture was increased to 65° C.

Next, a mixture solution composed of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer (trade name: AS-6, manufactured by TOAGOSEI CO., LTD.), 3.6 g of mercapto ethanol, 2.4 g of azobis dimethyl valeronitrile and 342 g of methylethylketone was delivered by drops into the flask in 2.5 hours. After the dripping, a mixture solution composed of 0.8 g of azobis methyl valeronitrile and 18 g of methylethylketone was delivered by drops into the flask in 0.5 hours. After the reaction mixture was aged at 65° C. for 1 hour, 0.8 g of azobis methyl valeronitrile was added thereto, the reaction mixture was further aged for 1 hour to thereby obtain 800 g of a polymer solution with a concentration of 50% by mass.

Then, 28 g of the obtained polymer solution, 26 g of copper phthalocyanine pigment, 13.6 g of 1 mol/L potassium hydroxide aqueous solution, 20 g of methylethylketone and 30 g of ion exchange water were sufficiently stirred. Subsequently, the mixture was kneaded 20 times using a three-roll mill (trade name: NR-84A, manufactured by Noritake Co., Ltd.) to obtain a paste. The obtained paste was placed into 200 g of ion exchange water, sufficiently stirred, and the methylethylketone and water therein were distilled away to thereby obtain 160 g of a cyan colored polymer fine particle dispersion with a solid content of 20.0% by mass.

The following ink composition was mixed with the obtained polymer fine particle dispersion, stirred, and then the mixture was filtered through a polypropylene filter having a pore diameter of 0.8 μm to thereby prepare a cyan ink with a viscosity of 8.3 mPa·s (25° C.) and a surface tension of 33.5 mN/m (25° C.).

—Ink Composition—

| | |
|---|---|
| cyan polymer fine particle dispersion | 55 parts by mass |
| 1,3-butanediol | 21 parts by mass |
| glycerine | 8 parts by mass |
| surfactant [$CH_3(CH_2)_{12}O\ (CH_2CH_2O)_3CH_2COOH$] | 2 parts by mass |
| ion exchange water | 14 parts by mass |

Example 4

A nozzle pattern was formed with an insulating dry film resist (DFR) on a support base prepared by Ni electrocasting, and then an Ni electrocasting layer to be a nozzle plate was formed by electrolytic plating. Subsequently, the DFR was removed to form a nozzle hole. On the inner wall of the nozzle hole and the nozzle surface formed by Ni-electrocasting, an Ni-PTFE eutectoid layer having a thickness of 2 μm was formed using an Ni-PTFE electrolytic plating solution (trade name: METAFLON, manufactured by Uemura & Co., Ltd.). Then, the Ni support base and the Ni electrocasting/Ni-PTFE eutectoid layer to be a nozzle plate were separated and subjected to a heat treatment at 350° C. for 1 hour, thereby preparing a nozzle plate. The surface energy of the Ni-PTFE eutectoid layers formed on the nozzle plate surface and the inner wall of the nozzle hole was 24.5 N/m (25° C.).

The filling property, ejection stability, and shelf property were evaluated in the same manner as in Example 1 except that a liquid ejector head using the thus prepared nozzle plate and the cyan ink prepared in Example 3 were used. Table 1 shows the evaluation results.

Example 5

A nozzle plate was prepared in the same manner as in Example 3 except that the layer of modified perfluoropolyoxetane (OPTOOL DSX, manufactured by Daikin Industries, Ltd.) was not formed on the nozzle surface and inside the nozzle hole.

In this case, the nozzle surface and the inner wall of the nozzle hole were respectively formed of polyimide (surface energy: 28.9 mN/m at 25°).

The filling property, ejection stability, and shelf property were evaluated in the same manner as in Example 1 except that a liquid ejector head using the thus prepared nozzle plate and the cyan ink prepared in Example 3 were used. Table 1 shows the evaluation results.

Example 6

The filling property, ejection stability, and shelf property were evaluated in the same manner as in Example 1 except that a magenta ink prepared as follows was used instead of the black ink prepared in Example 1. Table 1 shows the evaluation results.

<Preparation of Magenta Ink>

The following ink composition was mixed, stirred, and the mixture was filtered through a polypropylene filter having a pore diameter of 0.8 μm to thereby prepare a magenta ink with a viscosity of 2.0 mPa·s (25° C.) and a surface tension of 29.7 mN/m (25° C.).

—Ink Composition—

| | |
|---|---|
| Daiwa IJ Magenta R (manufactured by Daiwa Kasei Co., Ltd.) | 50 parts by mass |
| glycerine | 5.2 parts by mass |
| diethylene glycol | 15.6 parts by mass |
| surfactant (ECTD3NEX, manufactured by Nikko Chemicals Co., Ltd.) | 1.0 part by mass |
| LiOH | 0.15 parts by mass |
| ion exchange water | 28.05 parts by mass |

Example 7

The filling property, ejection stability, and shelf property were evaluated in the same manner as in Example 1 except that a black ink prepared as follows was used instead of the black ink prepared in Example 1. Table 1 shows the evaluation results.

<Preparation of Black Ink>

The following ink composition was mixed with the carbon black dispersion prepared in Example 1, stirred, and then the mixture was filtered through a polypropylene filter having a pore diameter of 0.8 μm to thereby prepare a black ink with a viscosity of 4.7 mPa·s (25° C.) and a surface tension of 28.2 mN/m (25° C.).

—Ink Composition—

| | |
|---|---|
| carbon black dispersion prepared in Example 1 | 30 parts by mass |
| acrylic silicone resin emulsion (NANOCRYL SBCX-2821, manufactured by Toyo Ink Mfg. Co., Ltd.) | 5 parts by mass |
| 1,3-butanediol | 15 parts by mass |
| glycerine | 5 parts by mass |
| fluorochemical surfactant (FS-300, manufactured by DuPont Co.) | 1.5 parts by mass |
| ion exchange water | 43.5 parts by mass |

Example 8

The filling property, ejection stability, and shelf property were evaluated in the same manner as in Example 1 except that a black ink prepared as follows was used instead of the black ink prepared in Example 1. Table 1 shows the evaluation results.

<Preparation of Black Ink>

The following ink composition was mixed with the carbon black dispersion prepared in Example 1, stirred, and then the mixture was filtered through a polypropylene filter having a pore diameter of 0.8 μm to thereby prepare a black ink with a viscosity of 7.5 mPa·s (25° C.) and a surface tension of 29.1 mN/m (25° C.).

—Ink Composition—

| | |
|---|---|
| carbon black dispersion prepared in Example 1 | 45 parts by mass |
| acrylic silicone resin emulsion (NANOCRYL SBCX-2821, manufactured by Toyo Ink Mfg. Co., Ltd.) | 8 parts by mass |
| 1,3-butanediol | 15 parts by mass |
| glycerine | 5 parts by mass |
| surfactant (ECTD3NEX, manufactured by Nikko Chemicals Co., Ltd.) | 2 parts by mass |
| ion exchange water | 25 parts by mass |

Example 9

The filling property, ejection stability, and shelf property were evaluated in the same manner as in Example 1 except that a black ink prepared as follows was used instead of the black ink prepared in Example 1. Table 1 shows the evaluation results.

<Preparation of Black Ink>

The following ink composition was mixed with the carbon black dispersion prepared in Example 1, stirred, and then the mixture was filtered through a polypropylene filter having a pore diameter of 0.8 μm to thereby prepare a black ink with a viscosity of 7.5 mPa·s (25° C.) and a surface tension of 26.1 mN/m (25° C.).

—Ink Composition—

| | |
|---|---|
| carbon black dispersion prepared in Example 1 | 45 parts by mass |
| 1,3-butanediol | 18 parts by mass |
| glycerine | 6 parts by mass |
| fluorochemical surfactant (FS-300, manufactured by DuPont Co.) | 2 parts by mass |
| ion exchange water | 29 parts by mass |

Comparative Example 1

In the preparation of the nozzle plate of Example 1, the inside of the nozzle hole and the nozzle back surface were masked with a water-soluble resin, a silicone resin layer was formed on the nozzle surface, and then the water-soluble resin layer was peeled off and removed so that the silicone resin layer was formed only on the nozzle surface and no silicone resin layer was formed inside the nozzle hole, thereby preparing a nozzle plate. The nozzle surface was formed of a silicone resin layer (surface energy: 23.9 mN/m at 25° C.), and the inner wall of the nozzle hole was formed by Ni electrocasting (surface energy: 30.5 mN/m at 25° C.).

The filling property, ejection stability, and shelf property were evaluated in the same manner as in Example 1 except that a liquid ejector head using the thus prepared nozzle plate and the black ink prepared in Example 1 were used. Table 1 shows the evaluation results.

Comparative Example 2

A nozzle plate was prepared in the same manner as in Example 2 except that a silicone resin layer was not formed inside the nozzle hole similarly to the nozzle plate prepared in Comparative Example 1. The nozzle surface was formed of a silicone resin layer (surface energy: 23.9 mN/m at 25° C.) and the inner wall of the nozzle hole was formed by Ni electrocasting (surface energy: 30.5 mN/m at 25° C.).

The filling property, ejection stability, and shelf property were evaluated in the same manner as in Example 1 except that a liquid ejector head using the thus prepared nozzle plate and the black ink prepared in Example 2 were used. Table 1 shows the evaluation results.

Comparative Example 3

In the preparation of the nozzle plate of Example 5, the nozzle plate (a layer treated with a modified perfluoropolyoxetane) was put on a silicone rubber sheet so that the surface of the nozzle plate was contacted with a surface of the silicone rubber sheet, and the polyimide layer was treated with an oxygen plasma from the back surface of the nozzle plate to change the surface energy of the inner wall of the nozzle hole to 40.2 mN/m at 25° C., thereby preparing a nozzle plate. The surface energy of the nozzle plate surface remained at 28.9 mN/m (25° C.) which was the same as the surface energy of the polyimide layer.

Comparative Example 4

A nozzle plate was prepared in the same manner as in Example 6 except that a silicone resin layer was not formed inside the nozzle hole similarly to the nozzle plate prepared in Comparative Example 1. The nozzle surface was formed of a silicone resin layer (surface energy: 23.9 mN/m at 25° C.) and the inner wall of the nozzle hole was formed by Ni electrocasting (surface energy: 30.5 mN/m at 25° C.).

The filling property, ejection stability, and shelf property were evaluated in the same manner as in Example 1 except that a liquid ejector head using the thus prepared nozzle plate and the magenta ink prepared in Example 6 were used. Table 1 shows the evaluation results.

Comparative Example 5

A nozzle plate was prepared in the same manner as in Example 7 except that a silicone resin layer was not formed inside the nozzle hole similarly to the nozzle plate prepared in Comparative Example 1. The nozzle surface was formed of a silicone resin layer (surface energy: 23.9 mN/m at 25° C.) and the inner wall of the nozzle hole was formed by Ni electrocasting (surface energy: 30.5 mN/m at 25° C.).

The filling property, ejection stability, and shelf property were evaluated in the same manner as in Example 1 except that a liquid ejector head using the thus prepared nozzle plate and the black ink prepared in Example 7 were used. Table 1 shows the evaluation results.

Comparative Example 6

A nozzle plate was prepared in the same manner as in Example 8 except that a silicone resin layer was not formed inside the nozzle hole similarly to the nozzle plate prepared in Comparative Example 1. The nozzle surface was formed of a silicone resin layer (surface energy: 23.9 mN/m at 25° C.) and the inner wall of the nozzle hole was formed by Ni electrocasting (surface energy: 30.5 mN/m at 25° C.).

The filling property, ejection stability, and shelf property were evaluated in the same manner as in Example 1 except that a liquid ejector head using the thus prepared nozzle plate and the black ink prepared in Example 8 were used. Table 1 shows the evaluation results.

Comparative Example 7

In the preparation of the nozzle plate of Example 9, the polyimide film prepared in Example 5 was used as a nozzle plate. Note that the nozzle surface and the inner wall of the nozzle hole respectively formed of polyimide had a surface energy of 28.9 mN/m at 25° C.

The filling property, ejection stability, and shelf property were evaluated in the same manner as in Example 1 except that a liquid ejector head using the thus prepared nozzle plate and the black ink prepared in Example 9 were used. Table 1 shows the evaluation results.

Comparative Example 8

A polyimide film (manufactured by DuPont Co.; trade name: CAPTON, no particle added) was processed to form a nozzle hole by using an excimer laser. Then, the inside of the nozzle hole was masked with a water-soluble resin, the back surface of the nozzle plate was masked with a tape. On the polyimide film surface, an $SiO_2$ layer having a thickness of 1 nm (10 angstroms) was formed by sputtering, and then a layer of modified perfluoropolyoxetane (OPTOOL DSX, manufactured by Daikin Industries, Ltd.) having a thickness of 3 nm (30 angstroms) (surface energy: 21.7 mN/m at 25° C.) was formed on the nozzle plate surface by vacuum evaporation method. Thereafter, the water-soluble resin masking the inside of the nozzle hole and the tape masking the back surface of the nozzle plate were removed, thereby preparing a nozzle plate in which the nozzle plate surface was formed with a modified perfluoropolyoxetane layer (surface energy: 21.7 mN/m at 25° C.) and the inner wall of the nozzle hole was formed of polyimide (surface energy: 28.9 mN/m at 25° C.).

The filling property, ejection stability, and shelf property were evaluated in the same manner as in Example 1 except that a liquid ejector head using the thus prepared nozzle plate and a cyan ink prepared in Example 3 were used. Table 1 shows the evaluation results.

TABLE 1

| | Surface energy of nozzle surface (mN/m) | Surface energy of inner wall of nozzle hole: A (mN/m) | Surface tension of ink: B (mN/m) | Difference (B − A) (mN/m) | Filling property | Ejection stability | Shelf property |
|---|---|---|---|---|---|---|---|
| Ex. 1 | 23.9 | 23.9 | 26.0 | 2.1 | A | A | A |
| Ex. 2 | 22.9 | 22.9 | 29.7 | 6.8 | A | A | A |
| Ex. 3 | 21.7 | 21.7 | 33.5 | 11.8 | B | A | A |
| Ex. 4 | 24.5 | 24.5 | 33.5 | 9.0 | A | B | A |
| Ex. 5 | 28.9 | 28.9 | 33.5 | 4.6 | A | B | B |
| Ex. 6 | 23.9 | 23.9 | 29.7 | 5.8 | A | A | A |
| Ex. 7 | 23.9 | 23.9 | 28.2 | 4.3 | A | A | A |
| Ex. 8 | 23.9 | 23.9 | 29.1 | 5.2 | A | A | A |

TABLE 1-continued

| | Surface energy of nozzle surface (mN/m) | Surface energy of inner wall of nozzle hole: A (mN/m) | Surface tension of ink: B (mN/m) | Difference (B – A) (mN/m) | Filling property | Ejection stability | Shelf property |
|---|---|---|---|---|---|---|---|
| Ex. 9 | 23.9 | 23.9 | 26.1 | 5.2 | A | A | A |
| Compara. Ex. 1 | 23.9 | 30.5 | 26.0 | −4.5 | A | D | D |
| Compara. Ex. 2 | 22.9 | 30.5 | 29.7 | −0.8 | A | D | D |
| Compara. Ex. 3 | 28.9 | 40.2 | 33.5 | −6.7 | A | D | D |
| Compara. Ex. 4 | 23.9 | 30.5 | 29.7 | −0.8 | A | C | C |
| Compara. Ex. 5 | 23.9 | 30.5 | 28.2 | −2.3 | A | C | C |
| Compara. Ex. 6 | 23.9 | 30.5 | 29.1 | −1.4 | A | C | D |
| Compara. Ex. 7 | 28.9 | 28.9 | 26.1 | −2.8 | A | C | D |
| Compara Ex. 8 | 21.7 | 28.9 | 33.5 | 4.6 | A | D | C |

INDUSTRIAL APPLICABILITY

Since a nozzle plate for liquid ejector head of the present invention and the liquid ejector head using a nozzle plate of the present invention are provided with filling property, ejection stability and reliability, they are preferably used in printers, facsimiles, copiers, or complex machines thereof, various types of image forming apparatuses such as plotters or other various types of patterning devices.

An inkjet recording apparatus and an inkjet recording method of the present invention can be used in various types of recording based on inkjet recording system, for example, can be particularly suitably used in inkjet recording printers, inkjet facsimiles, inkjet copiers, inkjet printer/facsimile/copier complex machines and the like.

The invention claimed is:

1. A nozzle plate for a liquid ejector head, comprising:

a nozzle hole for ejecting droplets composed of an ejection liquid, wherein a surface energy (A) of an inner wall of the nozzle hole at 25° C. is lower than a surface tension (B) of the ejection liquid at 25° C. and is substantially the same as a surface energy of an ejection side surface of the nozzle plate at 25° C.

2. The nozzle plate for a liquid ejector head according to claim 1, wherein a difference (B−A) of the surface tension (B) of the ejection liquid at 25° C. minus the surface energy (A) of the inner wall of the nozzle hole at 25° C. is greater than 0 mN/m and equal to or less than 10 mN/m.

3. The nozzle plate for a liquid ejector head according to claim 2, wherein the difference (B−A) of the surface tension (B) of the ejection liquid at 25° C. minus the surface energy (A) of the inner wall of the nozzle hole at 25° C. ranges between 2 mN/m and 7 mN/m.

4. The nozzle plate for a liquid ejector head according to claim 1, wherein the surface energy (A) of the inner wall of the nozzle hole at 25° C. is 25 mN/m or lower.

5. The nozzle plate for a liquid ejector head according to claim 1, wherein the inner wall of the nozzle hole comprises a silicone resin.

6. The nozzle plate for a liquid ejector head according to claim 1, wherein the inner wall of the nozzle hole comprises a fluorine-based water-repellency imparting agent.

7. A liquid ejector head comprising:

the nozzle plate for liquid ejector head according to claim 1.

8. A liquid ejector, comprising:

the liquid ejector head according to claim 7.

9. An inkjet recording apparatus comprising:

the liquid ejector according to claim 8, wherein an ink used as the ejection liquid is ejected by using the liquid ejector to thereby record an image.

10. The inkjet recording apparatus according to claim 9, wherein a viscosity of the ink is 5.0 mPa·s or more at 25° C.

11. The inkjet recording apparatus according to claim 9, wherein the ink comprises a pigment as a colorant.

12. The inkjet recording apparatus according to claim 9, wherein the ink comprises a resin.

13. The inkjet recording apparatus according to claim 9, wherein the ink comprises a fluoro-chemical surfactant.

14. A liquid ejection method comprising:

using at least the liquid ejector head according to claim 7.

15. An inkjet recording method comprising:

using the liquid ejection method according to claim 14, wherein an ink used as an ejection liquid is ejected according to the liquid ejection method to thereby record an image.

* * * * *